United States Patent [19]

Caveney et al.

[11] 3,946,769

[45] Mar. 30, 1976

[54] AUTOMATIC CABLE TIE INSTALLATION TOOL

[75] Inventors: Jack E. Caveney, Hinsdale; Roy A. Moody, Flossmoor; Ronald T. Fulton; Charles J. Rehling, both of Tinley Park, all of Ill.

[73] Assignee: Panduit Corporation, Tinley Park, Ill.

[22] Filed: Mar. 12, 1974

[21] Appl. No.: 450,523

[52] U.S. Cl. ..... 140/93.2; 140/123.6

[51] Int. Cl.[2] ..... B21F 9/02

[58] Field of Search ..... 140/93 A, 93.2, 93.4, 123.6

[56] References Cited

UNITED STATES PATENTS

| | | | |
|---|---|---|---|
| 3,118,473 | 1/1964 | Bell | 140/123.6 |
| 3,515,178 | 6/1970 | Hidassy | 140/93.2 |
| 3,633,633 | 1/1972 | Countryman | 140/93.2 |
| 3,810,498 | 5/1974 | Hidassy | 140/93 |

*Primary Examiner*—Lowell A. Larson
*Attorney, Agent, or Firm*—Charles R. Wentzel; Richard B. Wakely

[57] ABSTRACT

An automatic cable tie installation tool for assembling a cable tie about a bundle of wires or the like comprises a tool member, a dispenser member spaced from the tool member adapted to receive a cartridge containing a plurality of cable ties therein, and a conveyer member interconnecting the tool member and dispenser member. The dispenser member includes release means for releasing restraining means on the cartridge to permit egress of the cable ties contained in the cartridge, and transfer means for transmitting the cable ties into the conveyer member where the cable ties are transmitted to the tool member. The tool member comprises receiving means for receiving a cable tie from the dispenser, positioning means for positioning the cable tie in a closed loop about the bundle of wires, tensioning means for tensioning the cable tie about the bundle of wires, and severing means for cutting the tail of the cable tie once it has been tensioned about the bundle of wires.

15 Claims, 43 Drawing Figures

57
32
96
83
97
89
88
38
91
90
256
82
79
81
78

FIG.39
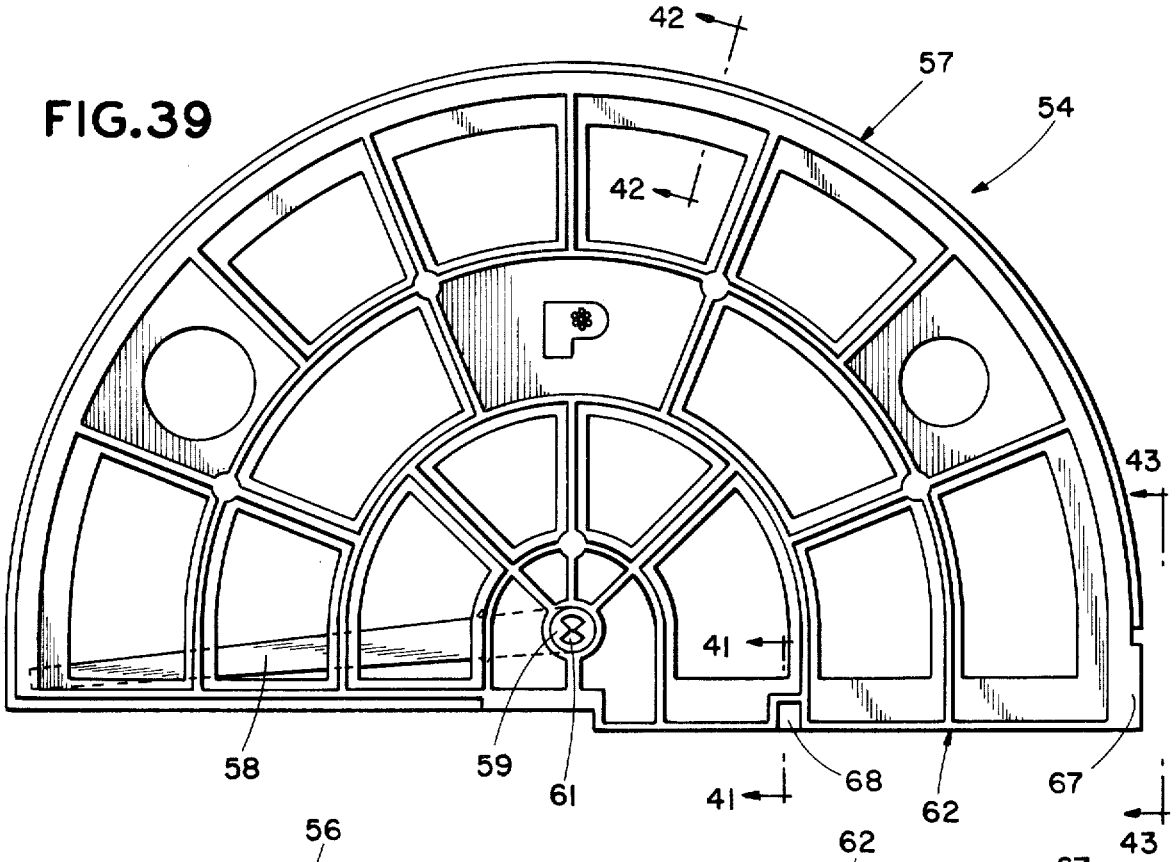
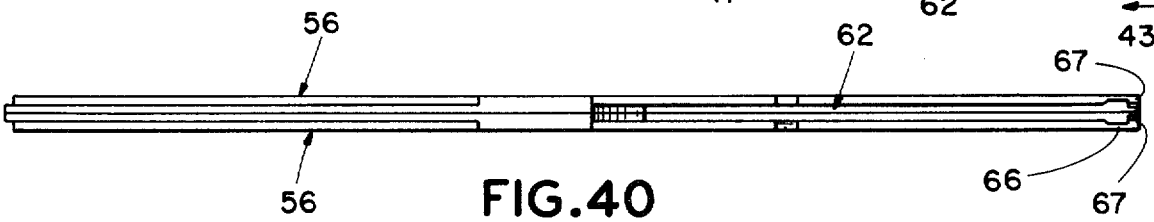
FIG.40
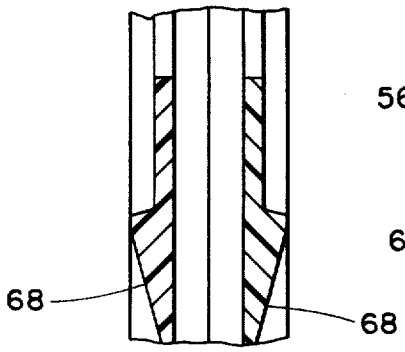
FIG.41
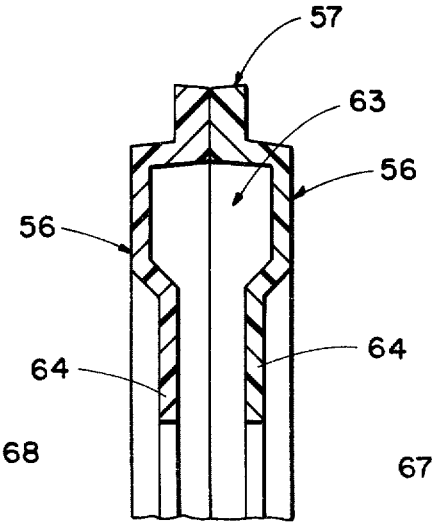
FIG.42
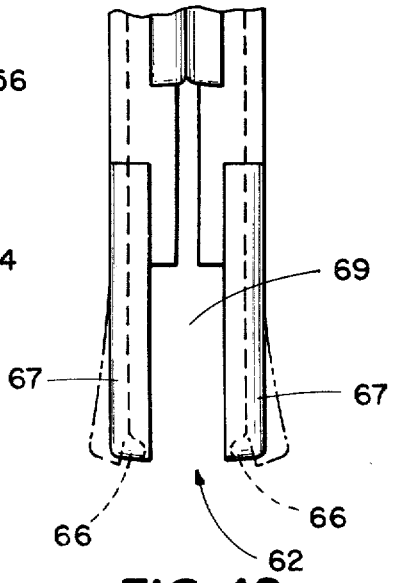
FIG.43

AUTOMATIC CABLE TIE INSTALLATION TOOL

This invention relates to the field of bundling a plurality of wires or the like and specifically to an automatic cable tie installation tool for fastening a cable tie about a bundle of wires or the like.

The prior art tools of this type have comprised a complex structure including a cartridge mounted directly on the tool containing a plurality of cable ties. A complex transferring mechanism was required to transfer the cable ties to the jaws of the tool. Since such a device was necessarily heavy when including the aforementioned structure, it was additionally required to utilize some type of counterbalancing system to attempt to eliminate the operator fatigue associated with utilizing the heavy prior art tool. Accordingly, it would be desirable to fabricate an automatic cable tie installation tool that is light-weight and fatigue-free when used without an awkward counterbalancing system.

The prior art tools utilized a plunger or ram to apply the force required to position a cable tie around the bundle and through the head of the cable tie. The plunger in addition to increasing the weight of the cable tie installation tool also produced a safety hazard inasmuch as the operator could have a finger pinched or smashed by movement of the plunger toward the bundle of wires which movement once initiated was not capable of being terminated. Accordingly, it would be desirable to provide an automatic cable tie installation tool wherein such a heavy and dangerous ram is eliminated.

Another problem of the prior art tools is that the actuating mechanism of the tools could be teased such that a tool cycle could be actuated prior to termination of the preceding cycle which would cause jamming of the tool. Accordingly, it would be desirable to provide an automatic cable tie installation tool wherein once the tool cycle is initiated, inadvertent or deliberate movement of the actuating mechanism by an operator will not initiate a second cycle until completion of the first cycle. It would additionally be desirable to provide such a tool with reset means wherein deliberate cessation of the initiated cycle can be accomplished.

Another problem with the prior art tools is that the jaws of the tools adapted to be positioned about a bundle of wires or the like once actuated could not be stopped and an operator's fingers could be positioned between the jaws whereby upon actuation of the tool cycle the fingers would be smashed between the jaws. It would therefore be desirable to provide a safety mechanism such that a predetermined force against closing of the jaws will prevent their closing thereby eliminating any possible injury to the operator.

Still another problem area in the prior art tools was that the cycle could be completed independent of the cable tie being positioned for tensioning about the bundle of wires or the like. This could result in an operator assuming a cable tie was properly positioned merely because the tool mechanically finished a cycle. The operator would then continue subsequent assembly operations and later have to go back and apply a cable tie in the same position. Such a procedure results in the loss of valuable operator time. It would accordingly be desirable to ensure that cycle actuation is not completed until a cable tie is properly positioned about a bundle of wires or the like.

In the prior art cartridges containing cable ties, it was necessary before inserting the cartridge into the tool to perform secondary operations resulting in the loss of expensive operator labor time. Accordingly, it would be desirable to fabricate a cartridge for use with an automatic cable tie installation tool wherein placement of the cartridge in a dispenser renders the cable ties positioned in the cartridge ready for transmittal to the tool member.

Accordingly, it is an object of the present invention to provide a new and improved automatic cable tie installation tool. It is another object of the present invention to provide an automatic cable tie installation tool that is light-weight and fatigue-free even when used without a counterbalancing system. It is a further object of the present invention to provide an automatic cable tie installation tool wherein inadvertent movement of the actuating mechanism will not initiate a second cycle of the tool until completion of the first cycle. Yet another object of the present invention is to provide a cable tie installation tool wherein the tool orients a cable tie so as to guarantee threading the tip of the cable tie through the cable tie head. Still another object of the present invention is to provide an automatic cable tie installation tool wherein potential injury to an operator is substantially eliminated. An additional object of the present invention is to provide an automatic cable tie installation tool wherein cycle completion will not occur unless the cable tie is properly positioned in the tool. A still further object of the present invention is to provide an automatic cable tie installation tool wherein a dispenser containing a cartridge having cable ties disposed therein is spaced from the hand held tool member. Yet a further object of the present invention is to provide an automatic cable tie installation tool having a fluid operated mechanism which sequentially applies a cable tie about a bundle of wires or the like, tightens the cable tie to a predetermined tension, cuts off and ejects the severed tip of the cable tie. Yet an additional object of the present invention is to provide a cartridge adapted to contain a plurality of cable ties for use with the automatic cable tie installation tool wherein the cartridge may be simply inserted in a dispenser without secondary operations being required to permit egress of the cable ties contained in the cartridge. Still another object of the present invention is to provide an automatic cable tie installation tool wherein a signal is given to the operator indicating the dispenser must be reloaded. Other objects and advantages of the present invention will become apparent as the following description proceeds and the features of novelty characterizing the invention will be pointed out with particularity in the claims annexed to and forming a part of this specification.

Briefly, the present invention comprises an automatic cable tie installation tool for fastening a cable tie under a predetermined tension about a bundle of wires or the like. The tool comprises a hand held tool member, a dispenser member spaced from the tool member for receiving a cartridge containing cable ties, and a conveyer member interconnecting the tool member and dispenser member. The tool member comprises receiving means for receiving a cable tie from the dispenser, positioning means for positioning the cable tie in a closed loop about the bundle of wires, tensioning means for tensioning the cable tie about the bundle of wires and severing means for cutting the tail of the cable tie once it has been tensioned about the bundle of wires. The dispenser member comprises a cartridge receiving opening, release means for releasing restraining means on the cartridge to permit egress of the cable ties contained therein and transfer means for transferring the cable ties into the conveyer member.

For a better understanding of the present invention, reference should be made to the accompanying drawings wherein the same reference numerals have been applied to like parts and wherein:

FIG. 3 is shown in full.

FIG. 3 is shown in full.

FIG. 3 is shown in full.

FIG. 17 is shown in full.

FIG. 18 is shown in full.

FIG. 29 is shown in full.

FIG. 39 is a front view of the cartridge built in accord with the present invention.

FIG. 40 is a bottom view of FIG. 39.

FIG. 41 is a sectional view taken along Lines 41—41 of FIG. 39.

FIG. 42 is a sectional view taken along Lines 42—42 of FIG. 39.

FIG. 43 is a partial end view of FIG. 39 taken along Lines 43—43.

Figure 1:
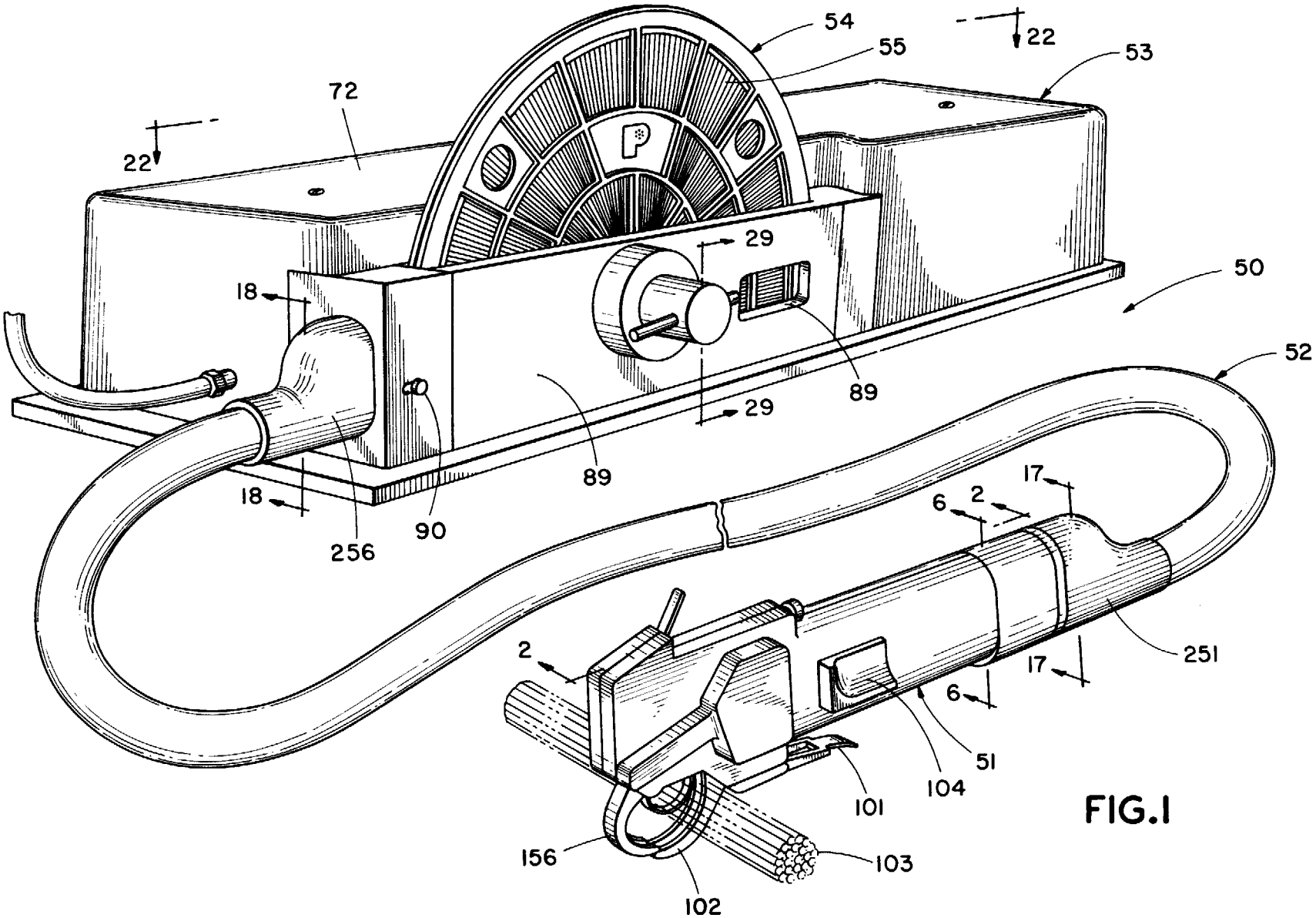
FIG. 1 is a reduced perspective view of the automatic cable tie installation tool built in accord with the present invention.

Referring now to the drawings, there is shown in FIG. 1 an automatic cable tie installation tool generally indicated at 50 comprising a tool member generally indicated at 51, a conveyer member generally indicated at 52 and a dispenser member generally indicated at 53 having a cartridge 54 containing a plurality of self-locking cable ties 55 positioned therein. The cable ties 55 are of the type comprising a strap portion and a head portion having a strap-receiving opening therethrough as exemplified by Caveney et al. U.S. Pat. No. 3,660,869 assigned to the same assignee as the present invention.

Figure 35:
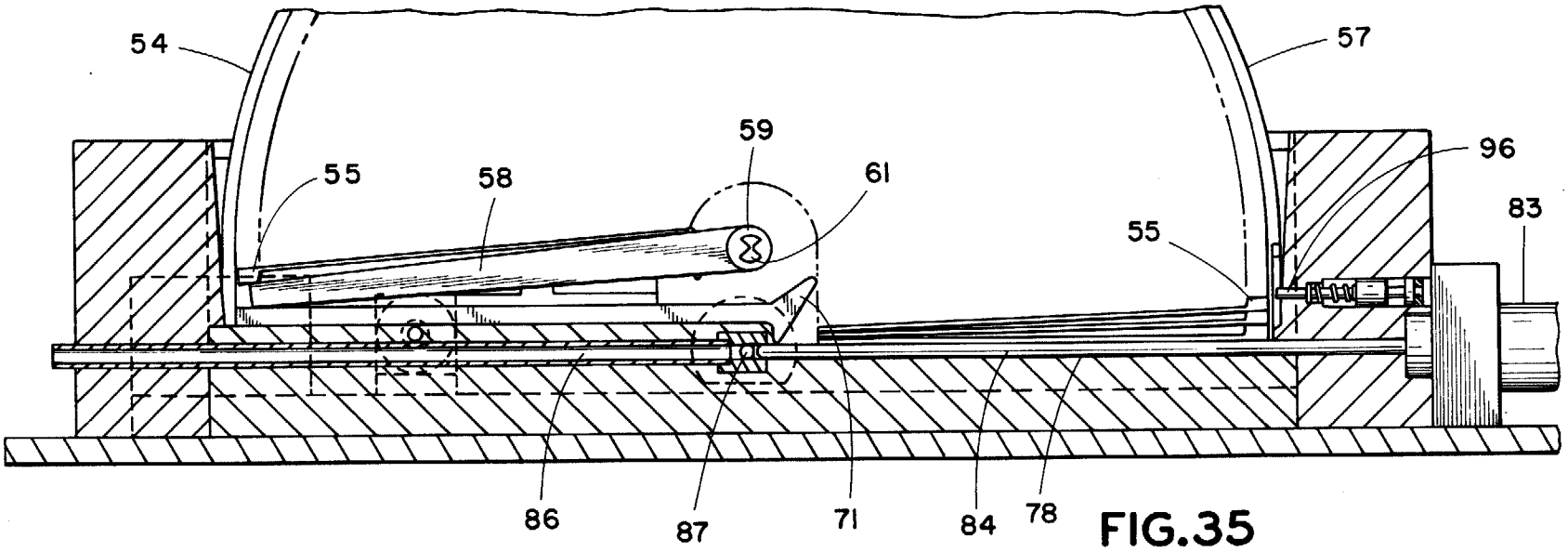
FIG. 35 is a partial sectional view taken along Lines 35—35 of FIG. 22, assuming a cartridge is positioned in the dispenser.

Referring now to FIGS. 39–43, the cable tie cartridge 54 is disclosed comprising a pair of sides 56 suitably secured together along the interface adjacent their outer edge 57 and having a feeder arm 58 rotatably supported therebetween at 59. The feeder arm 58 has a keyed aperture 61 for receiving a driver to resiliently bias the cable ties contained therein to a cable tie exit opening 62. The sides 56 adjacent the edge 57 define a cable tie head opening 63 to permit passage of a cable tie head therethrough. The body portions 64 of the sides 56 are positioned apart a distance sufficient to permit the passage of the strap portion of a cable tie supported in the cartridge 54. Adjacent the exit opening 62, a flange 66 extends inwardly from each of the sides into the cable tie head opening a distance sufficient to prevent egress of a cable tie. Release means in the form of a projection 67 extends outwardly adjacent the cable tie exit opening 62 from each of the sides. As best shown in FIG. 41, a locator portion 68 of each of the sidewalls tapers inwardly adjacent the exit opening 62 to define locating means. As shown in FIG. 43, the rear of the cartridge adjacent the exit opening is provided with a probe opening 69. The cartridge is provided with a stop 71 as shown in FIG. 35 to limit movement of the feeder arm 58 to a position wherein the feeder arm ensures movement of the last cable tie out of the cartridge.

Figure 22:
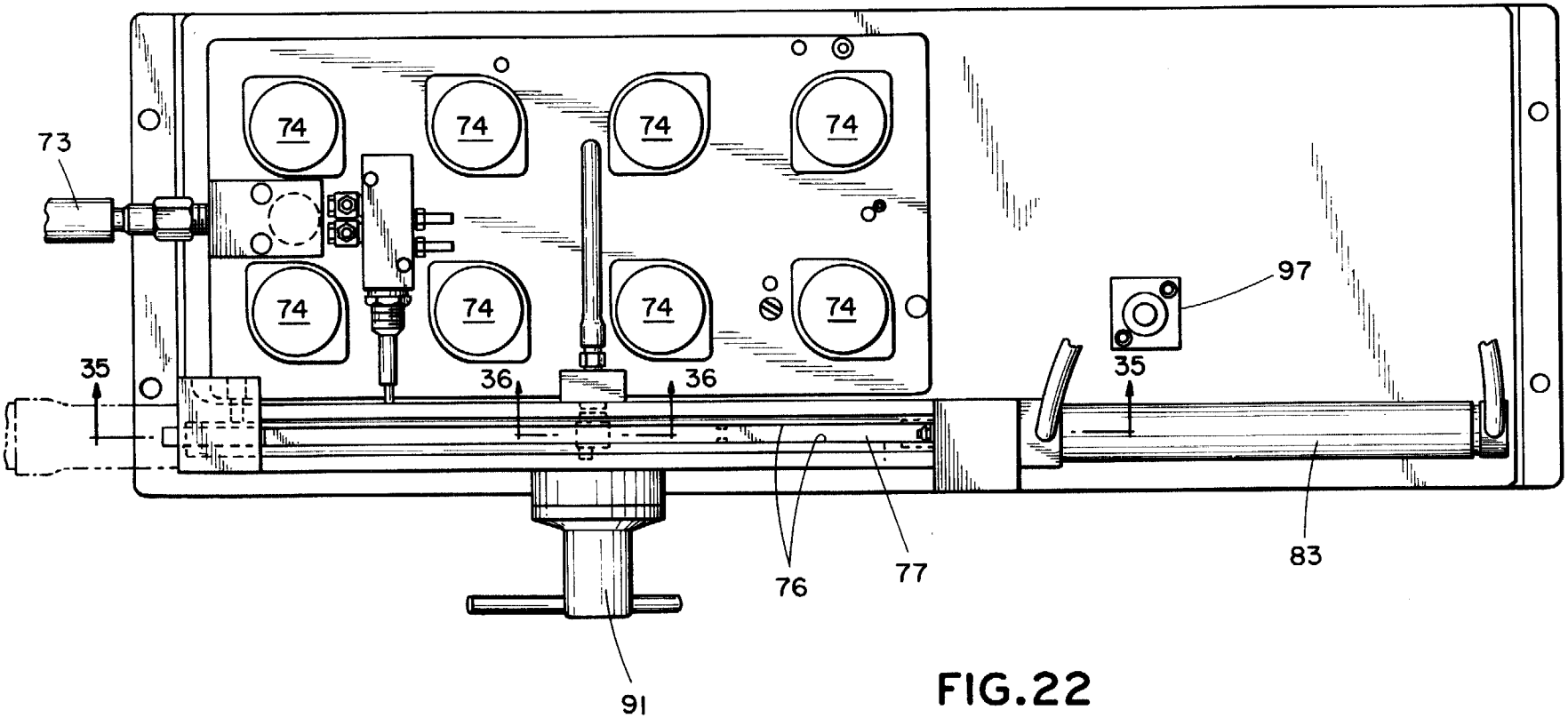
FIG. 22 is a top view taken along Lines 22—22 of FIG. 1, with the cover and cartridge removed.

As best shown in FIG. 22, the dispenser member 53 is shown with the cover 72 removed therefrom and comprises an outside fluid fitting 73 adapted for suitable connection to a source of fluid under pressure. The dispenser member 53 includes a plurality of manifold mounted valve modules 74, the particular structure of which is not shown as these modules are commercially available and their function is pointed out with particularity in the description of FIGS. 24 through 29.

Figures 31, 32, 33, 34:
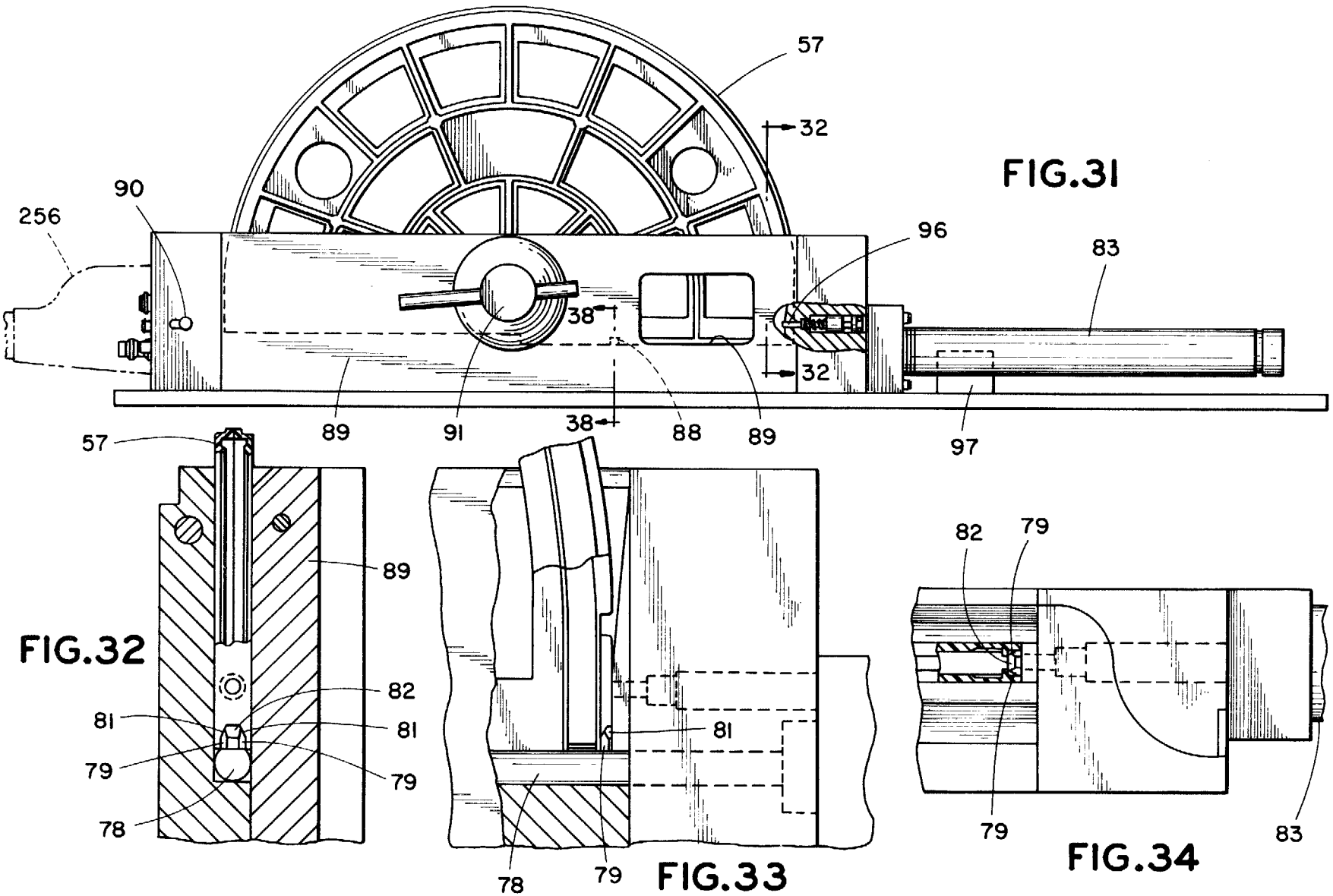
FIG. 31 is a front view of the dispenser member of FIG. 1, with the cover removed and parts broken away.
FIG. 32 is an enlarged sectional view taken along Lines 32—32 of FIG. 31.
FIG. 33 is a side view of FIG. 32 with parts broken away to show the positioning of the cartridge relative to the dispenser.
FIG. 34 is a sectional view taken along Lines 34—34 of FIG. 33 with the cartridge removed.
Figure 36:
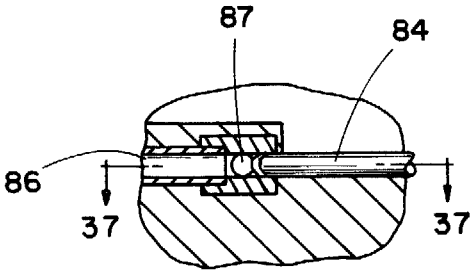
FIG. 36 is an enlarged partial sectional view taken along Lines 36—36 of FIG. 22.

The dispenser member 53 includes a cartridge receiving means in the form of a pair of spaced sidewalls 76 defining a cartridge receiving opening 77 therebetween as best shown in FIG. 22. A cable tie chamber 78, as shown in FIGS. 32, 33 is disposed adjacent the cartridge receiving opening 77. At the right hand end of the cartridge receiving opening, release means is positioned comprising in the preferred embodiment, a plurality of cam surfaces 79, 81, 82. A first pair of cam surfaces 79 converge to the left in FIGS. 22, 34, and a second pair of cam surfaces 81 converge in the direction of the cartridge receiving opening 77. The cam surface 82 tapers rearwardly from the cartridge receiving opening 77. Referring now to FIG. 35, a pneumatic cylinder 83 having a rod 84 positioned for movement due to air pressure in the cylinder, is positioned adjacent the cable tie chamber 78. The rod 84 is supported for movement from a first position behind a cable tie disposed in the chamber 78 to a second position wherein the rod transfers the cable tie from the cable tie chamber 78 into a dispenser cable tie tube 86. A passageway 87 is provided in the dispenser cable tie tube 86 for transmitting fluid under pressure behind the head of a cable tie positoned therein. It will be appreciated that when the rod 84 seals the end of the dispenser cable tie tube 86 as best shown in FIG. 36 and fluid under pressure enters passageway 86, the cable tie is transmitted through the conveyer member 52 to the tool member 51.

Figure 38:
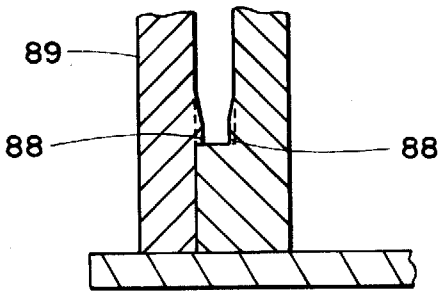
FIG. 38 is a sectional view taken along Lines 38—38 of FIG. 31.
Figure 37:
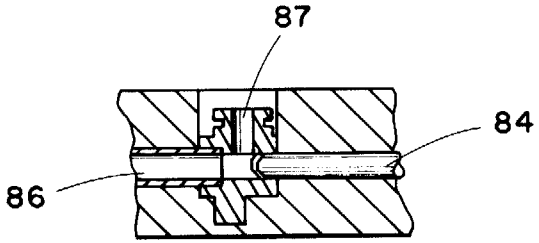
FIG. 37 is a sectional view taken along Lines 37—37 of FIG. 36.

Cartridge locators in the form of a pair of spaced uprights 88 are positioned as shown in FIG. 38 extending into the cartridge receiving opening 77 to properly position the cartridge in the cartridge receiving opening by mating with the tapering locator portions 68 of the cartridge 54. As shown in FIG. 1, the dispenser is provided with an access door 89 having a releasable lock 90 positioning the door adjacent the cartridge receiving opening and defining a wall thereof. It will be appreciated that removal of the door permits access to the cable tie chamber for removing any cable ties that could possibly be jammed therein.

Figure 29:
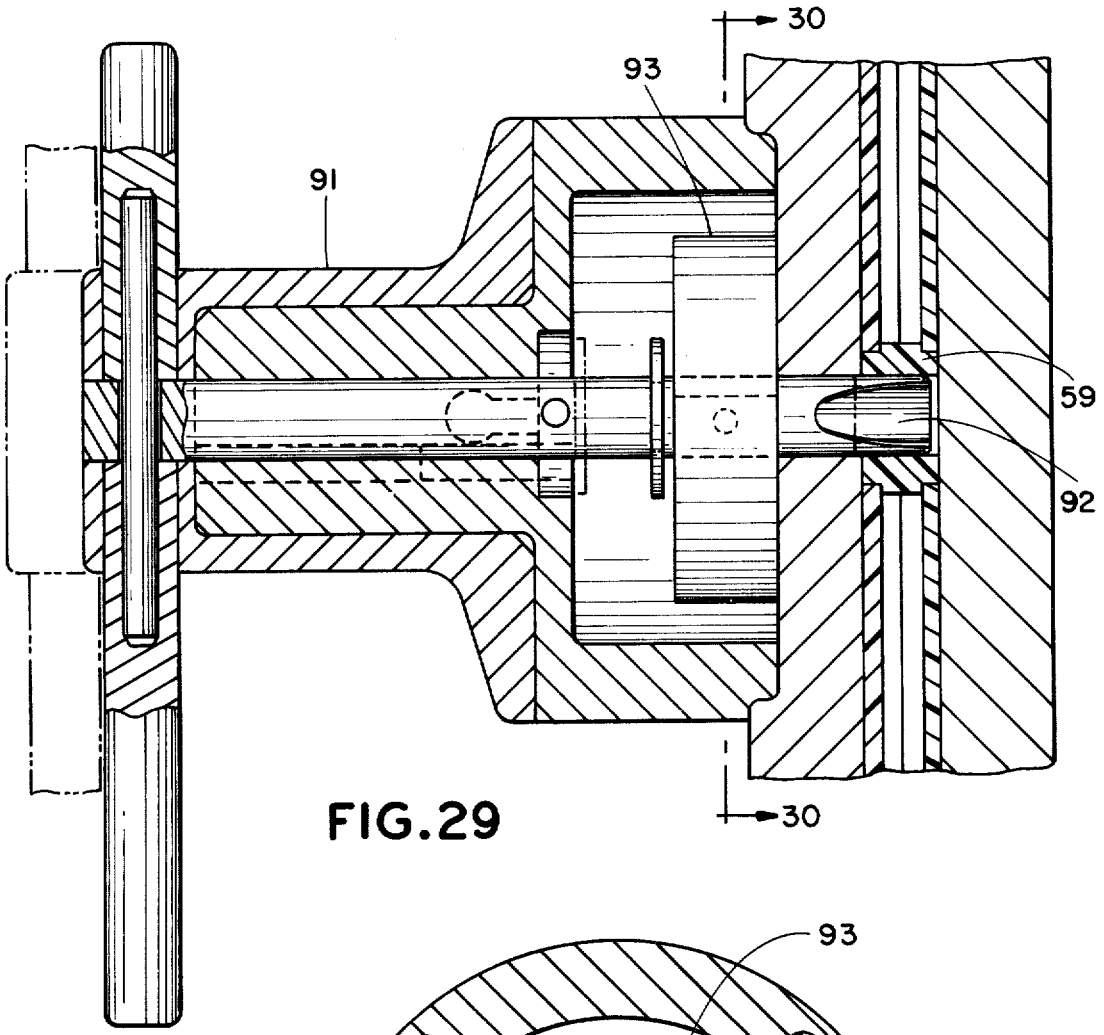
FIG. 29 is a partial sectional view taken along Lines 29—29 of FIG. 1.
Figure 30:
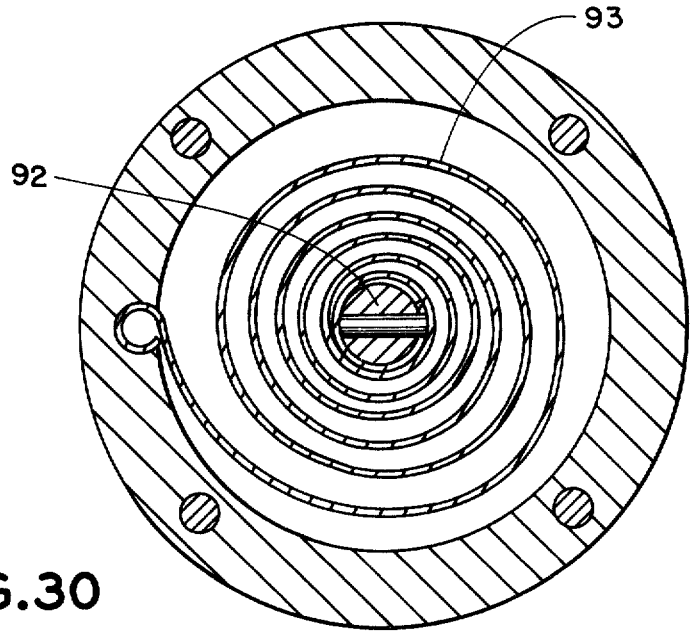
FIG. 30 is a sectional view taken along Lines 30—30 of FIG. 29, assuming

A load handle 91 rotatably supported on the door is best shown sectioned in FIG. 29 and comprises a keyed driver 92 spring biased so that the driver enters the cartridge receiving opening 77 for mating engagement with the keyed portion 61 of feeder arm 58. A coiled spring 93 as shown in FIG. 30 biases the load handle 91 for movement in a clockwise direction from the position as shown in FIG. 1. In order to position a cartridge 54 in the cartridge receiving opening 77, the load handle 91 is engaged and moved to the phantom position of FIG. 29 whereupon the driver 92 is removed from the cartridge receiving opening 77 permitting insertion of the cartridge with the cartridge locator means 68 positioned in engagement with the cartridge locators 88 and the cam surfaces 79 engaging the projections 67 to separate the cartridge sides 56 at the exit opening 62, as shown in phantom in FIG. 35, and widen the space between the flanges 66 to permit egress of a cable tie into the cable tie chamber 78. The handle is then rotated counterclockwise while in the phantom position of FIG. 29 and released whereupon the driver enters the keyed aperture 61 in the feeder arm 58 whereupon the cable ties 55 are resiliently biased to the exit opening 62. Upon retraction of the rod 84 from the cable tie chamber 78, the cable tie adjacent the exit opening 62 is resiliently biased into the cable tie chamber 78 by the feeder arm 58. As shown in FIG. 35, a probe 96 is mounted in the dispenser for movement through the probe opening 69 in the cartridge 54 and pneumatically connected to a signal 97 (FIG. 22) thereby when the feeder arm 58 has resiliently urged the last cable tie in the cartridge into position in the cable tie chamber 78 and moved below the probe opening 69, the probe movement of the probe 96 into the cartridge 54 opens a valve which actuates the signal 97. When the probe 96 enters the cartridge 54 and engages the feeder arm 58 or a cable tie, the signal 97 is not actuated.

Figure 2:
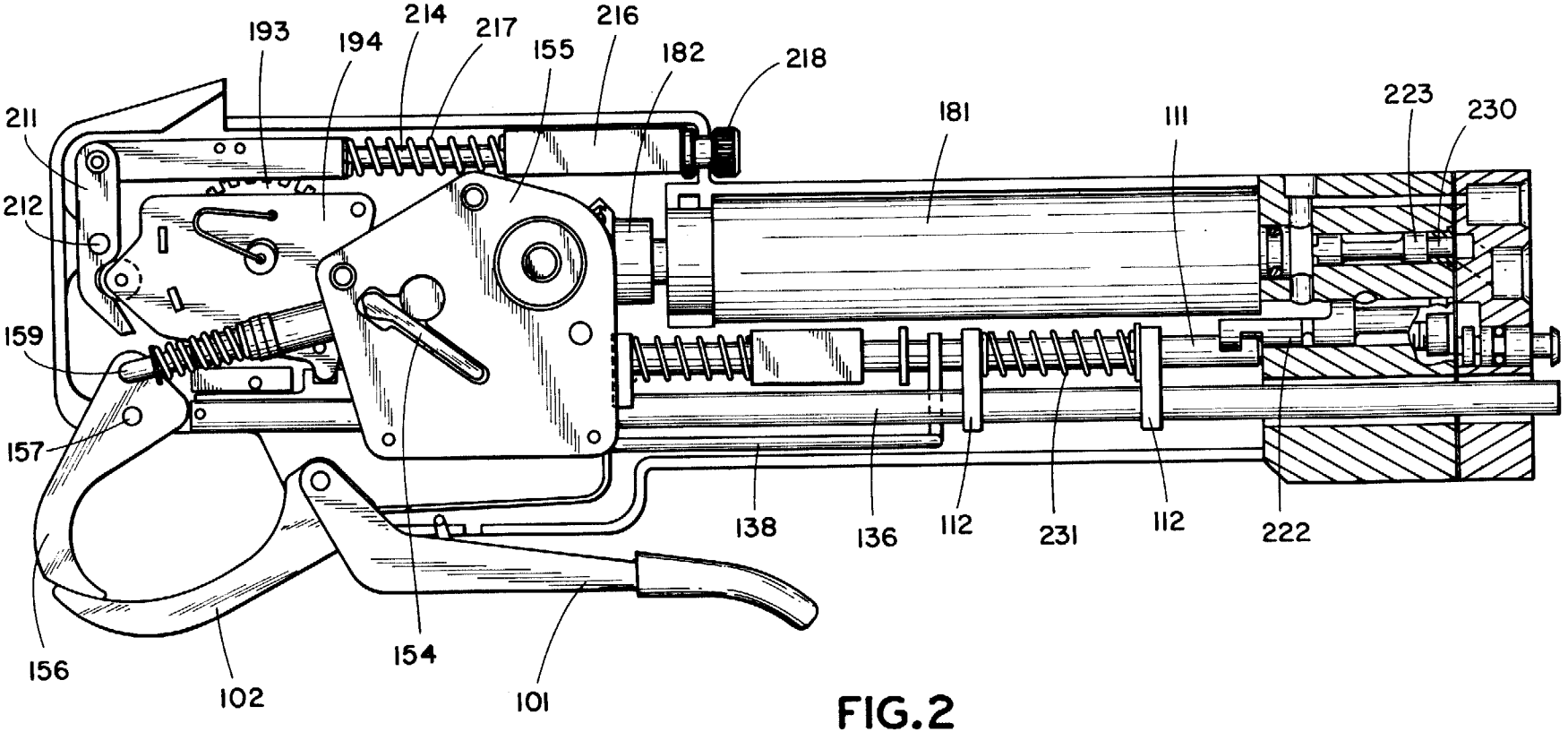
FIG. 2 is an enlarged sectional view taken along Lines 2—2 of FIG. 1.
Figure 3:
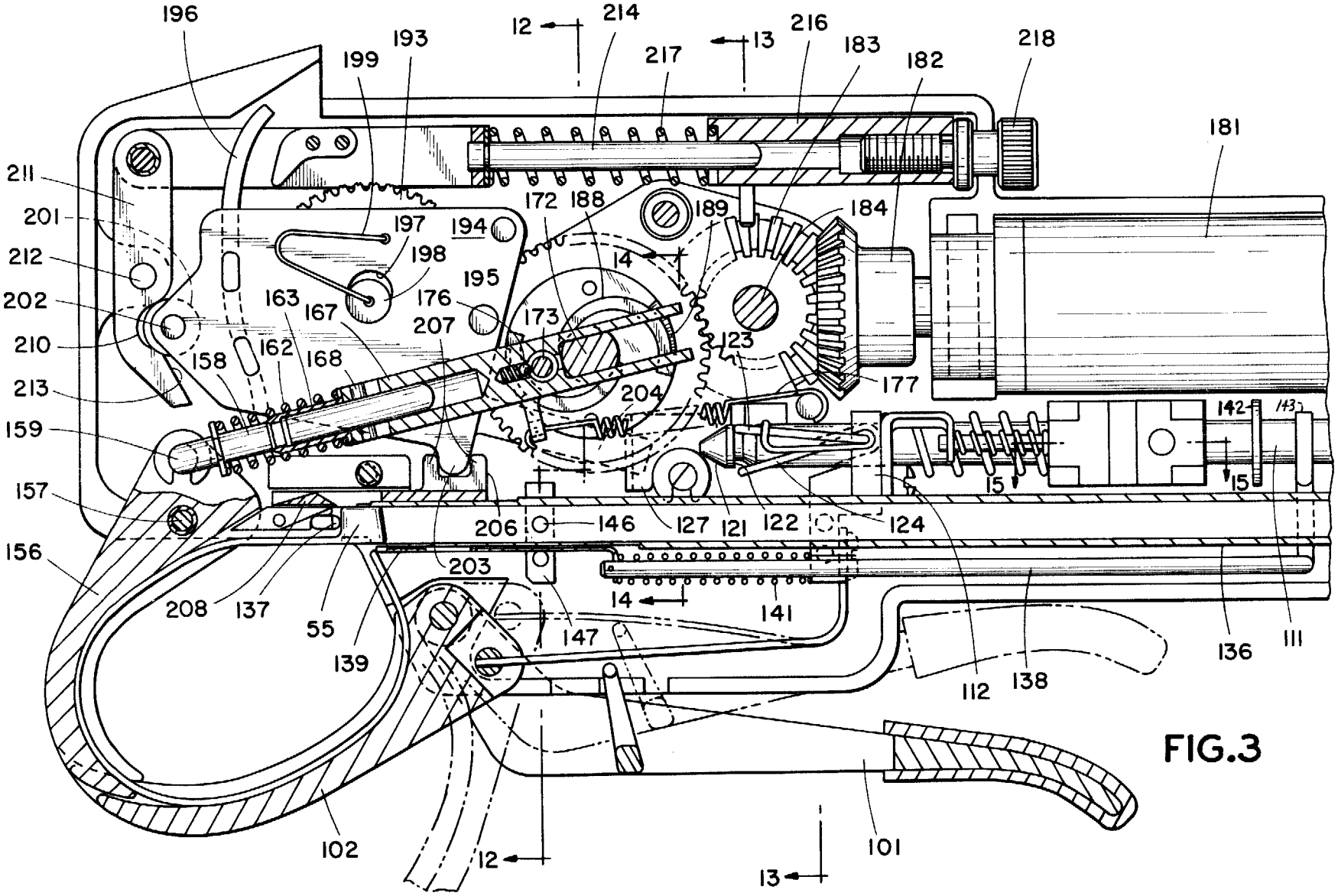
FIG. 3 is an enlarged partial sectional view similar to FIG. 2 with parts removed and showing the relationship of the parts with a cable tie positioned for assembly.
Figures 12, 13, 14, 15, 16:
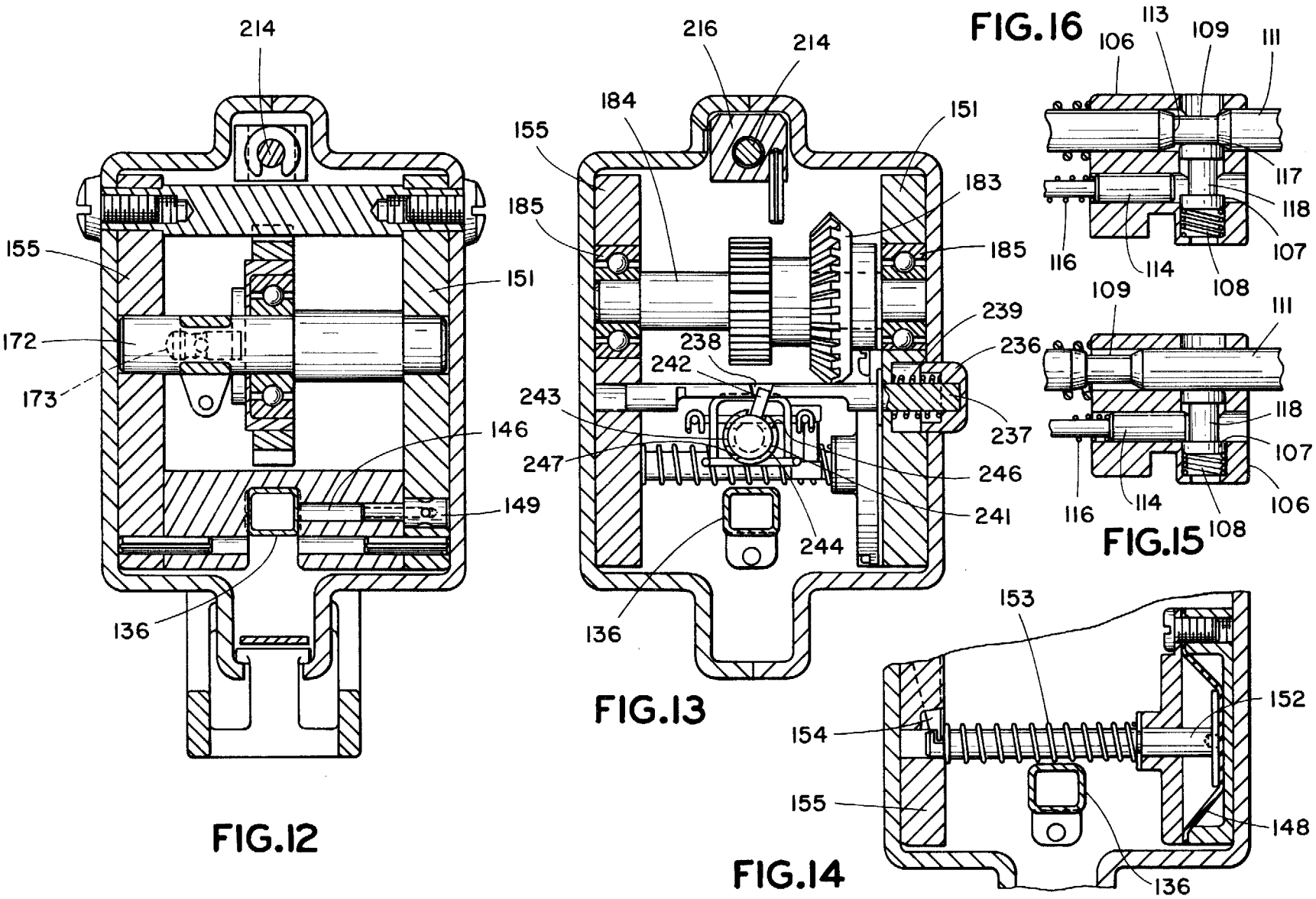
FIG. 12 is a sectional view taken along Lines 12—12 of FIG. 3 assuming
FIG. 13 is a sectional view taken along Lines 13—13 of FIG. 3 assuming
FIG. 14 is a partial sectional view taken along Lines 14—14 of FIG. 3 assuming
FIG. 15 is a partial sectional view taken along Lines 15—15 of FIG. 3.
FIG. 16 is a sectional view similar to FIG. 15 showing the position of the parts at initiation of the tool cycle.

Referring now to the tool member 51, it is adapted to be hand held and has positioned thereon jaw actuating means in the form of a jaw trigger 101 resiliently connected to a lower jaw 102 such that movement of the jaw trigger 101 to the position shown in phantom in FIG. 3 so as to permit placement of the tool member about a bundle of wires 103 as shown in FIG. 1. A thumb slide 104 is disposed in the tool housing as shown in FIG. 1 for relative movement to initiate actuation of the tool cycle. The thumb slide 104 is suitably connected to a spring biased actuator block 106 shown in FIGS. 15 and 16 as comprising an actuator pin 107 resiliently biased by a spring 108 into engagement with a reduced diameter portion 109 of actuator means in the form of an actuator rod 111. The actuator rod 111 is suitably supported in the tool member 51 by a plurality of actuator rod supports 112 as shown in FIGS. 2 and 15. Movement of the actuator block 106 to the left in FIG. 16 will cause the actuator pin 107 to also move to the left engaging the shoulder 113 of the actuator rod 111 and urging it to also move. As the actuator pin 107 moves to the left, it engages an actuator pin retainer 114 and resiliently urges the actuator pin retainer 114 against the bias of spring 116. As the actuator rod 111 continues to move to the left as will be hereinafter described, the actuator pin 107 is cammed outwardly against the bias of spring 108 by a cam surface 117 on the actuator rod 111 from the position in FIG. 16, to the position as shown in FIG. 15, whereupon the actuator pin retainer 114 abuts against the reduced diameter portion 118 of the actuator pin 107 and prevents the actuator pin 107 from returning to the position of FIG. 16. It should be appreciated that movement of the actuator block 106 relative to the pin retainer 114, once the actuator rod 111 is in the position of FIG. 15, will cause the actuator pin retainer 114 to engage the actuator pin 107 and prevent movement thereof toward the actuator rod. If the actuator rod 111 should return to the position of FIG. 16, it will be necessary to also return the actuator block 106 to the position of FIG. 16 before the actuator pin 107 is free is move into engagement with the reduced diameter portion 109.

The forward end of the actuator rod 111 as best shown in FIG. 3, comprises a conical cam surface 121 and retaining means in the form of a reduced diameter portion forming a detent 122. Movement of the actuator rod 111 to the position as shown in FIG. 3 causes the cam surface 121 to pass between a primary wire latch 123 and a secondary spring latch 124 such that the primary wire latch 123 is positioned in the detent 122 so as to prevent inadvertent rearward movement of the actuator rod 111 from the position as shown in FIG. 3. The primary wire latch 123 and secondary spring latch 124 are longitudinally offset relative to the detent 122 so that when the primary wire latch 123 is positioned in the detent 122, the secondary spring latch 124 is spaced rearwardly therefrom as shown in FIG. 3.

Figure 5:
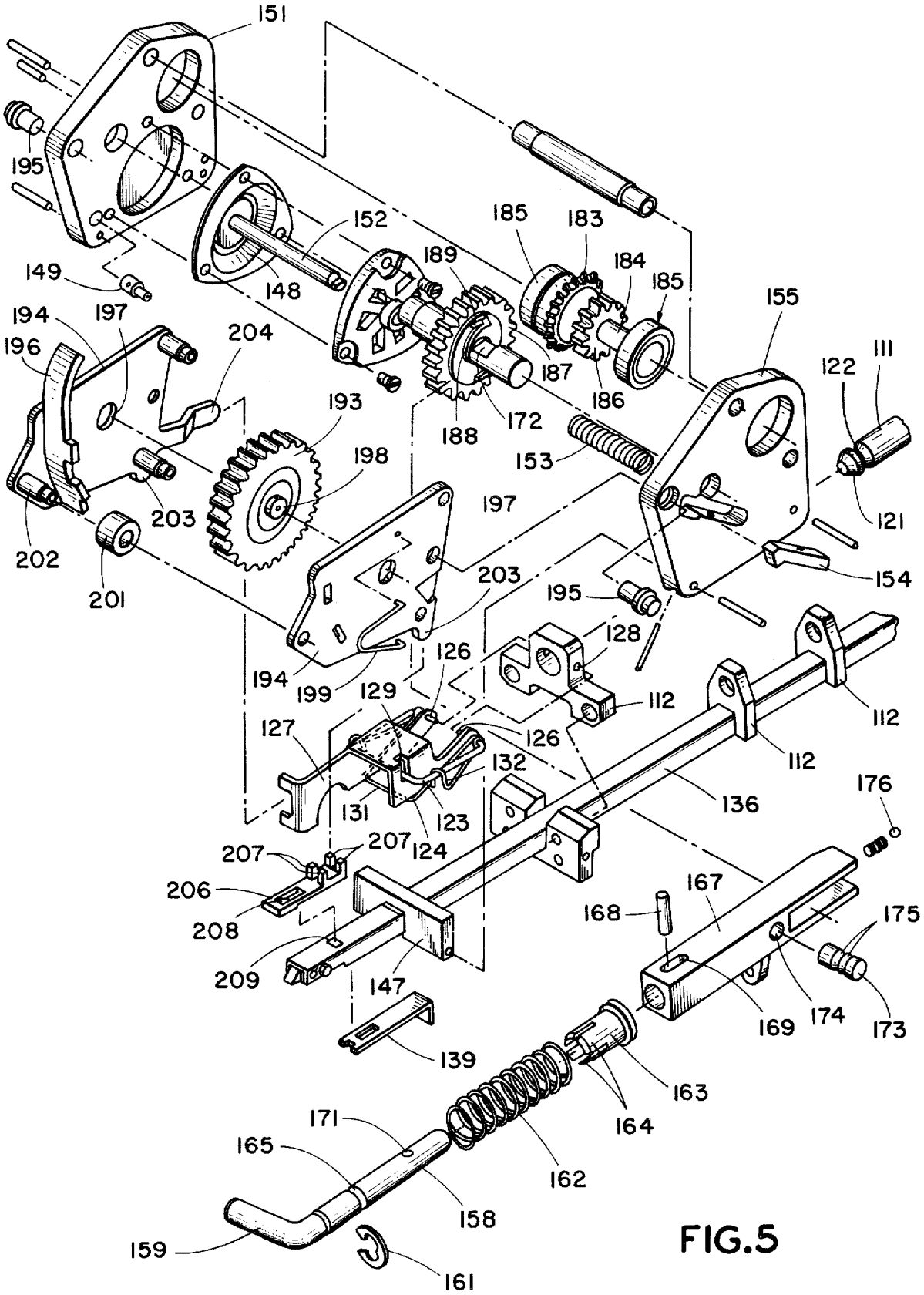
FIG. 5 is an exploded isometric view showing the tool member mechanism.

As best shown in FIG. 5, the primary wire latch 123 has a pair of ends 126 passing through apertures in a latch frame 127 and anchored in apertures 128 in one of the actuator rod supports 112 thereby permitting both the primary wire latch 123 and latch frame 127 to pivot. The portion of the primary wire latch 123 engaging the detent 122 is positioned such that upward movement of the latch frame 127 from the position in FIG. 3 will cause upward movement of the primary wire latch 123 out of engagement with the detent 122. Limited downward movement of the latch frame 127 can occur without movement of the primary wire latch 123 since the primary wire latch extends through elongated vertical slots 129 in latch frame 127. The secondary spring latch 124 has its latching portion 131 positioned against the lowermost portion of the latch frame 127 and is pivotally wound around the ends 126 of the primary wire latch 123. Ends 132 of the secondary spring latch 124 are looped over the primary wire latch 123 to bias the primary wire latch into the position of FIG. 3.

Receiving means in the form of a cable tie tube 136 is positioned in the tool member 51 for receiving a cable tie 55 from the dispenser member 53 as will be hereinafter more particularly described. Air pressure in the cable tie tube 136 urges the cable tie 55 to the position as shown in FIG. 3 wherein the head of the cable tie is positioned against a head stop or abutment 137. The cross-sectional rectangular configuration of the cable tie tube 136 cooperates with the cable tie head configuration and maintains the desired orientation of the cable tie 55 as it is transmitted from the dispenser member 53 into position against the abutment 137. A cable tie head retainer rod 138 is positioned for movement with the actuator rod 111 and has a head retainer 139 connected thereto and positioned to engage the head of the cable tie 55 to prevent inadvertent removal of the cable tie prior to assembly of the cable tie about the bundle of wires or the like. As shown in FIG. 3, the head retainer rod 138 is biased to the position as shown by a suitable spring 141. A retainer ring 142 is secured to the actuator rod 111 and constrained to move therewith whereby movement of the actuator rod to the right from the position shown in FIG. 3 causes the retainer ring to engage the end 143 of the head retainer rod 138 and move the head retainer 139 to the right permitting egress of the cable tie from the tool after completion of the cycle. An inlet passageway 146 passing through a cable tie tube support 147 interconnects the cable tie tube 136 through its aperture with a diaphragm 148 through an air passage pin 149 positioned in mounting plate 151 as best shown in FIGS. 5 and 12. The mounting plate 151 is provided with an air passageway permitting air to flow behind the diaphragm 148. The diaphragm 148 is connected to a diaphragm rod 152 which is resiliently biased to the position shown in FIG. 14, by a suitable biasing means as shown in the form of a spring 153. The end of the diaphragm rod 152 opposite the diaphragm 148 is connected to a pin actuating link 154 suitably pivotably supported in mounting plate 155.

An upper jaw 156 is pivotably secured to the tool housing by a jaw pivot 157. Jaw actuating means in the form of a jaw actuator rod 158 is secured to the upper jaw 156 through the jaw actuating pivot 159. A retainer ring 161 is positioned on the rod 158 for retaining a jaw actuator spring 162 having one end disposed against the retainer ring and the other end disposed against a sleeve 163 having a plurality of arms 164 disposed in a detent 165 on the jaw actuator rod 158. The jaw actuator rod 158 is connected for relative movement to a jaw actuator block 167 by means of a jaw actuator pin 168 disposed in a slot 169 in the jaw actuator block 167 and positioned in a hole 171 in the jaw actuator rod 158. Thus it will be appreciated that movement of the jaw actuator block 167 produces movement of the jaw actuator rod 158 unless a force is applied to the jaw actuator rod 158 sufficient to cam the arms 164 out of the detent 165 whereupon the pin 168 is free to move the length of the slot 169 before movement of the jaw actuator rod 158 will continue. Thus it will be appreciated that in the event an operator's fingers are placed between the jaws 102, 156, movement of the upper jaw 156 will cease prior to exerting a force on the operator's fingers sufficient to cause injury.

The end of the jaw actuator block 167 disposed opposite the sleeve 163 is forked and supported for movement on a flatted portion of a cam gear shaft 172. A cam detent pin 173 is disposed in an actuator block aperture 174 and provided with detents 175 for engaging a spring biased detent positioner 176. The jaw actuator block 167 is suitably spring biased to the position as shown in FIG. 3 by a return spring 177.

Figure 4:
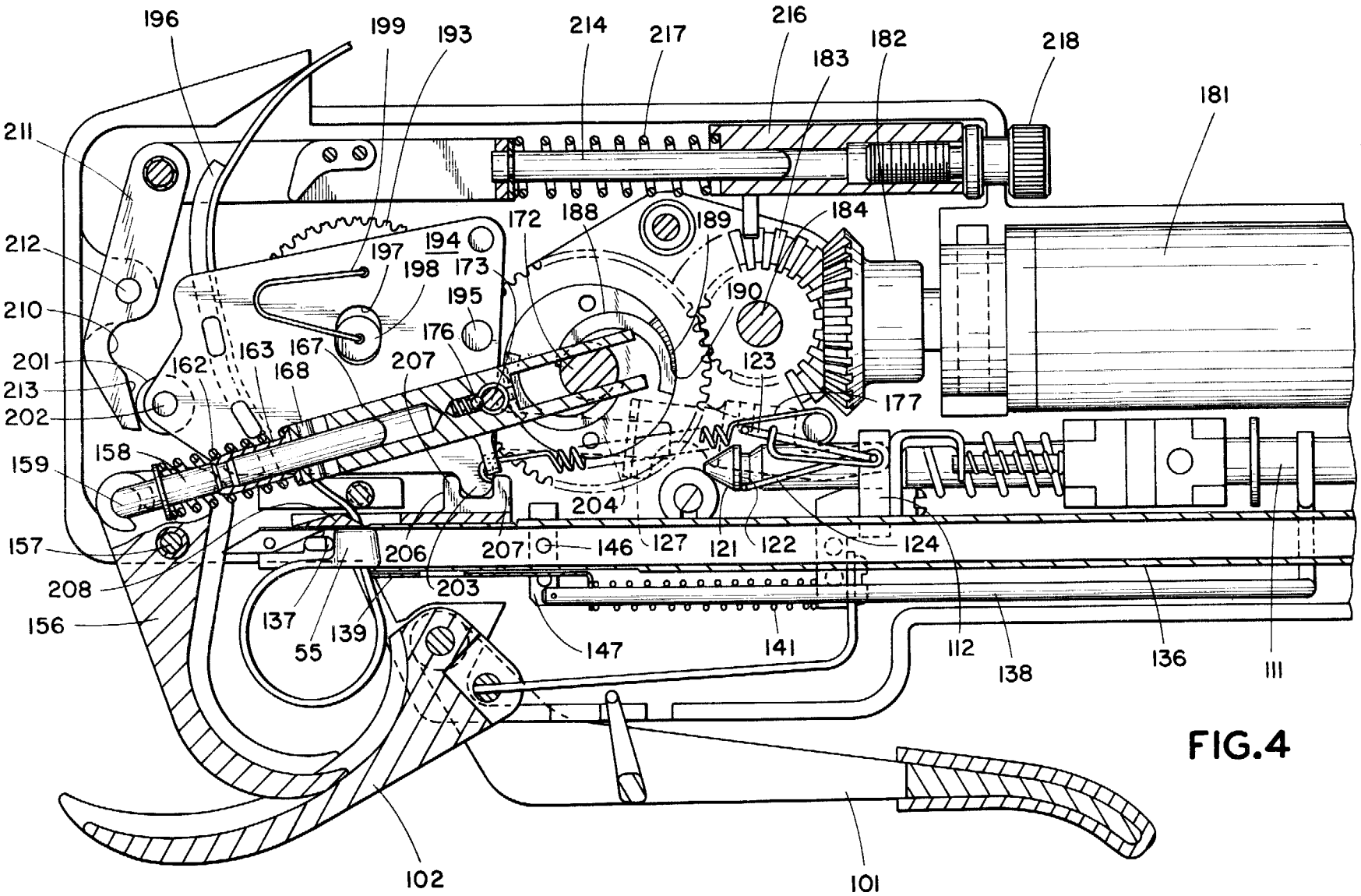
FIG. 4 is a sectional view similar to FIG. 3 showing the relationship of the parts at cut-off.

A fluid actuated motor 181 is suitably mounted in the tool member housing and drives a motor gear 182 positioned for engagement with bevel gear 183 suitably supported in the housing on bevel gear shaft 184 mounted on bearings 185. Transfer gear 186 is also secured to the bevel gear shaft 184 and positioned for engagement with a cam gear 187 supported for rotational movement about the flatted cam gear shaft 172. The cam gear as best shown in FIGS. 3, 4, and 5 has on one side a pair of radial ramps 188 extending from the center of the gear arcuately radially outwardly therefrom. At the tip of each of the ramps 188, an additional lateral ramp 189 extends transversely from the face of the gear outwardly from the face of the gear to a height corresponding to the height of the radial ramps 188 as best shown at 190 on FIG. 4.

The tool member 51 is provided with tensioning means including a gripper gear 193 having a pair of gripper teeth on each of its gear teeth and positioned for driving engagement with the cam gear 187. The gripper gear 193 is supported for relative movement between a pair of gripper plates 194. The gripper plates are supported for pivotal movement in the tool member 51 about a pair of pivot pins 195 and have a strap guide 196 positioned therebetween and spaced from the gripper gear 193 a distance sufficient to permit movement of the strap portion of a cable tie 55 therebetween. In order to eliminate the influence of any external drive force to the gripper gear 193, pivot pin 195 is positioned on the pitch line between cam gear 187 and gripper gear 193. The gripper plates 194 permit translational movement of the gripper gear 193 relative to the strap guide 196 by means of an elongated slot 197 rotatably supporting the gripper gear shaft 198. As best shown in FIG. 3, a gripper gear spring 199 resiliently biases the gripper gear 193 to a position closely adjacent the strap guide 196. It will be appreciated that the geometry of the slots 197 is such that the gripping forces on the strap portion of a cable tie 55 positioned between the gripper gear 193 and the strap guide 196 are increased upon attempted removal of the strap portion so as to provide a self-energizing aspect to the gripper gear 193. As the gripper gear 193 rotates to permit removal of the strap portion, a force is applied on the gripper gear shaft 198 urging it to the lower portion of slots 197 wherein the gripper gear teeth are closer to the strap guide 196. By providing a rotary feed the length of the strap portion capable of being tensioned through the head portion is theoretically infinite. The prior art tools relying on a gripper attached to a movable rod were limited to tensioning the strap an amount corresponding to the stroke of the rod.

A cam follower 201 is supported by a cam follower pin 202 positioned between the gripper plates 194. Each of the gripper plates 194 is provided with a cutter blade actuator 203 and the right gripper plate is provided with a latch release leg 204. The latch release leg 204 is positioned for engagement with the latch frame 127. Severing means in the form of a cutter blade 206 having upstanding arms 207 on each side is disposed adjacent the cable tie tube 136 having a cutter portion 208 positioned adjacent to a cable tie aperture 209 in the cable tie tube 136 such that movement of the cutter blade 206 to the right in FIG. 3 urges the cutter portion 208 against the strap portion of a cable tie 55 passing through the aperture 209 and forcing the strap portion against the rear abutment or wall of the cable tie aperture 209 severing the cable tie as shown in FIG. 4. The arms 207 are positioned for engagement with cutter blade actuators 203.

The cam follower 201 is positioned in a detent 210 on a pivotal arm 211 suitably mounted in the tool member 51 for pivotal movement about pin 212. A cam surface 213 is provided opposite the detent 210 from the pivot 212 on the pivotal arm 211. The arm 211 is suitably biased into the position as shown in FIG. 3 by any suitable adjusting biasing means connected to the pivotal arm 211 at a point on the opposite side of the pin 212 from the detent 210 and cam surface 213. As shown in FIGS. 3 and 4, suitable biasing means urging the detent 210 to the position as shown in FIG. 3 comprises a rod 214 secured to a yoke pivotally mounted at one end to the pivotal arm 211 and having its other end disposed for longitudinal relative movement in a block 216. A spring 217 abuts against the block 216 urging the rod 214 and connected arm 211 to the position as shown in FIG. 3. At the end of the block 216 opposite the spring 217, a tension adjusting knob 218 is threaded into the end of the block 216 such that rotational movement of the knob will move the block 216 longitudinally thereby increasing or decreasing the biasing force on the pivotal arm 211.

Figure 6:
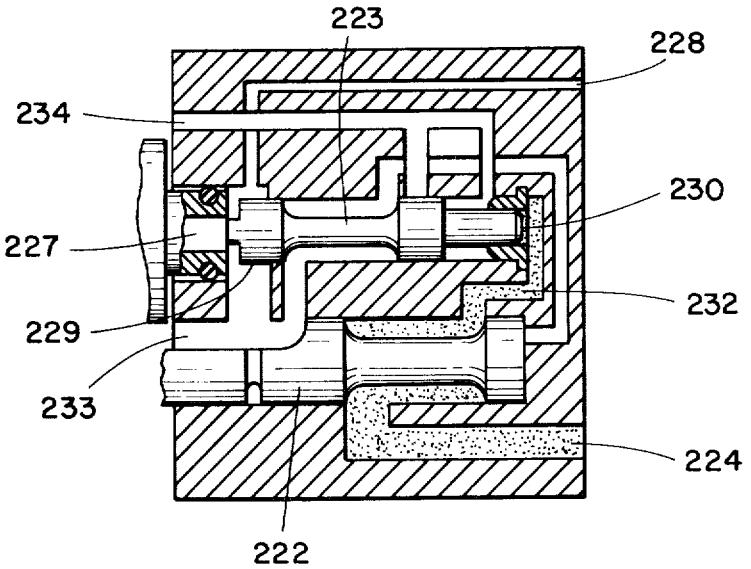
FIGS. 6 through 11 are sectional views taken along Lines 6—6 of FIG. 1 showing the parts of the valve thereof during a completed cycle of the automatic tool.
Figure 7:
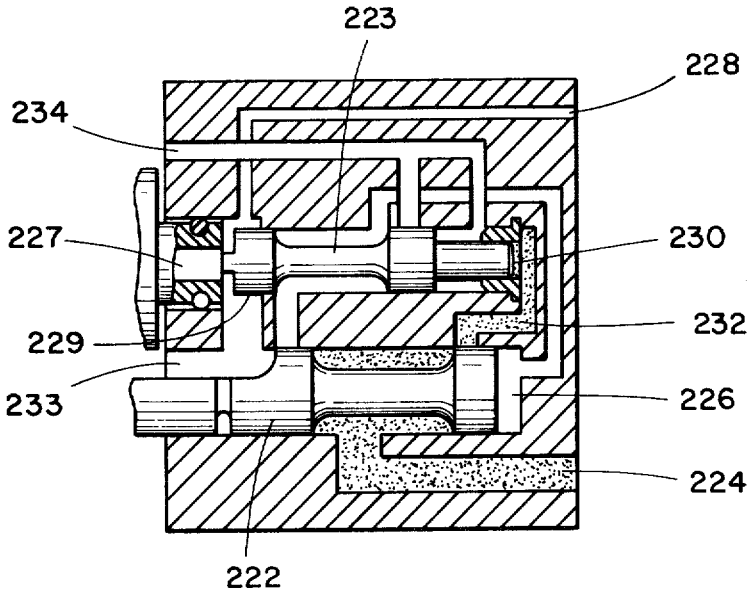
Figure 8:
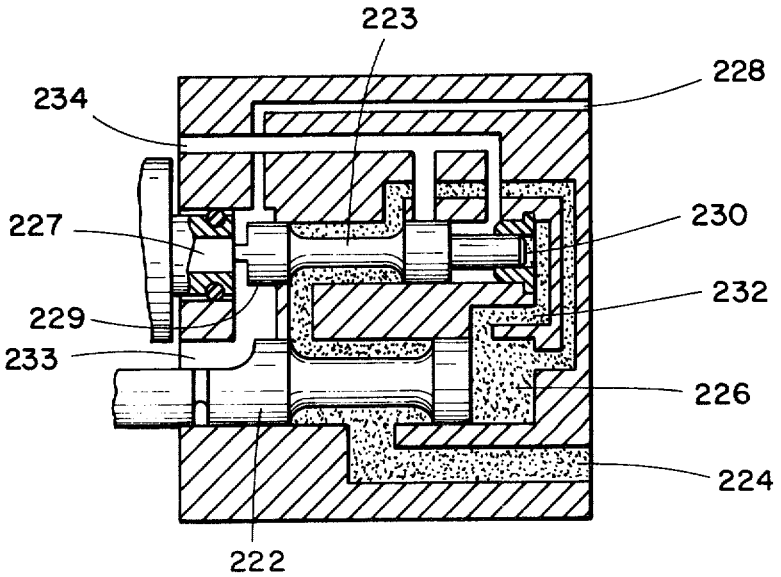
Figure 9:
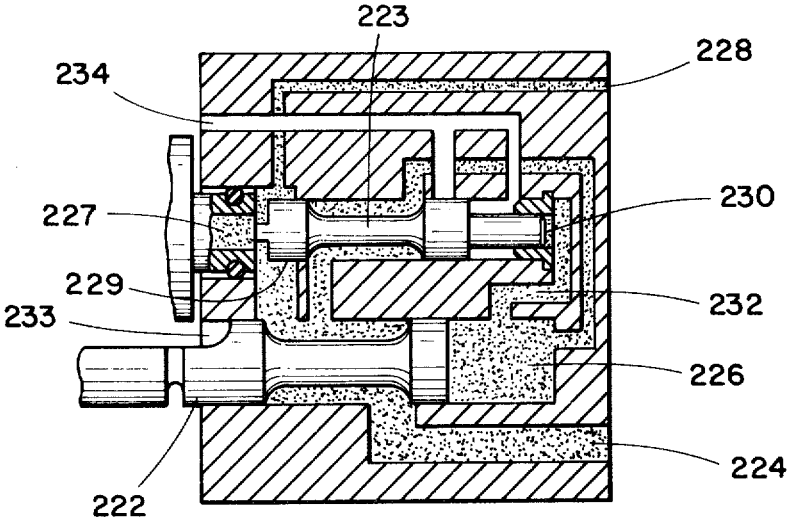
Figure 10:
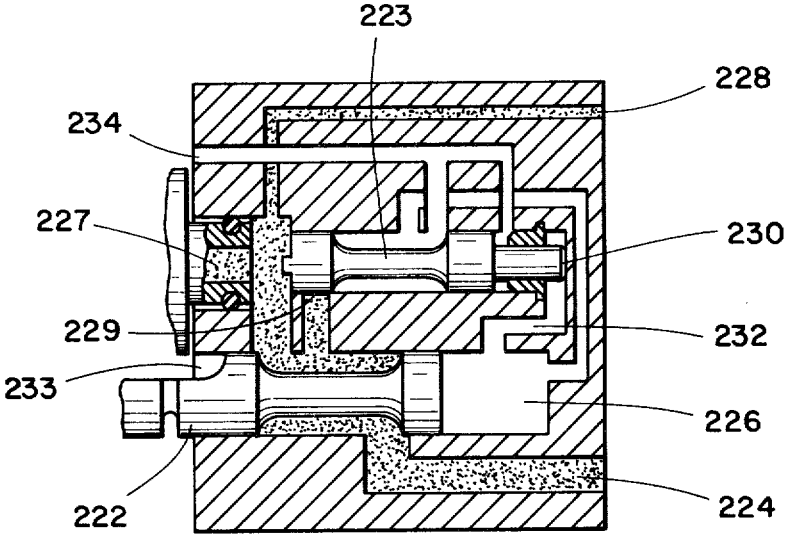
Figure 11:
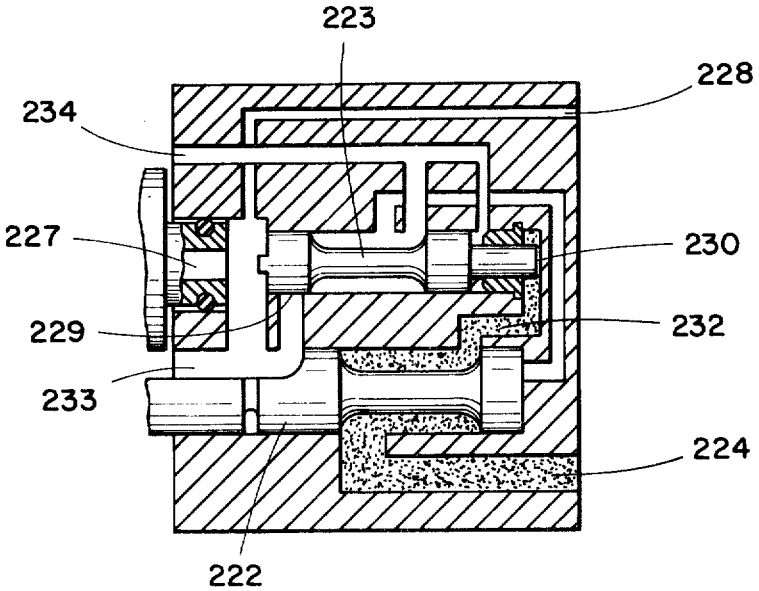

Referring now to FIGS. 6 through 11, the valve spool is disclosed comprising a primary spool 222 connected to the actuator rod 111 and a secondary spool 223 as best shown in FIG. 2. FIG. 6 shows the normal position of the primary spool 222 and secondary spool 223 when the tool is connected to a source of fluid under pressure which enters the valve at 224. For the purpose of clarity, the presence of fluid under pressure is shown in FIGS. 6 through 11 by means of dots. FIG. 7 shows the position of the primary spool 222 and secondary spool 223 after initial movement of the thumb slide 104 has moved the actuator block 106 and the actuator rod 111 as hereinbefore described. Continued movement of the thumb slide 104 moves the primary spool 222 to the position as shown in FIG. 8 which position is the maximum amount of travel brought about by movement of the thumb slide 104. In the position shown in FIG. 8, air moves behind the primary spool 222 at 226 urging the primary spool to the position as shown in FIG. 9. With the primary spool in the position of FIG. 9, the actuator rod 111 is in the position of FIG. 3 such that the primary wire latch 123 is positioned in the detent 122 so as to prevent movement of the actuator rod 111. In this position, air enters the motor 181 through the line 227 and turns the motor gear 182 and associated gears connected thereto. Air additionally enters the pilot line 228 so that a signal is transmitted to the dispenser member 53 to transmit a cable tie 55 from the dispenser member to the tool member. In the position of FIG. 9, air pressure on the motor end 229 of the secondary spool is equal to the pressure on the actuating piston end 230 thereof whereupon the difference in area where the pressure is applied causes the secondary spool 223 to move to the right in FIG. 9 to the position as shown in FIG. 10. In this position, air continues to be supplied to the motor 181 and into the pilot line 228. The motor will thus run until the primary wire latch 123 and secondary spring latch 124 are released permitting the actuator rod 111 to return to its stable position under the force of a return spring 231 shown in FIG. 2. Since the primary spool 222 is connected to the actuator rod 111, movement also returns the primary spool to the position of FIGS. 6 and 11 opening the air port 232 putting pressure on the actuating piston end of the secondary spool forcing the secondary spool into the position as shown in FIG. 6 whereupon the cycle is ready to be repeated. Air exhausts from the valve spool 221 at 233 and 234.

Referring now to FIG. 13, reset means is disclosed and comprises a reset button 236 connected to a reset shaft 237 having an aperture 238 extending therethrough. The reset button 236 is biased into the position as shown in FIG. 13 by a suitable reset spring 239. Latch release means in the form of a substantially tubular member 241 having an actuator arm 242 positioned in the aperture 238 is disposed around the actuator rod 111 and has a pair of latch release segments 243 and 244 projecting between the primary wire latch 123 and secondary spring latch 124. Looking at FIG. 13, it will be appreciated that upon movement of the reset button 236 to the left, the tubular member 241 will be rotated counterclockwise whereupon an upper edge 246 of the right latch release segment 244 will engage the primary wire latch 123 and the lower edge 247 of the left latch release segment 243 will engage the secondary spring latch 124 and bring about relative separation between the primary wire latch and secondary spring latch. This disengages the detent 122 in the actuator rod 111 from the primary wire latch 123 and secondary spring latch 124 whereupon the actuator rod 111 will return under its spring bias to its original position and terminate continuation of an existing cycle. It will be appreciated that the tool member 51 could be used with many combinations of dispensers or even a hand feed supplying a single cable tie into the cable tie tube 136.

Figure 17:
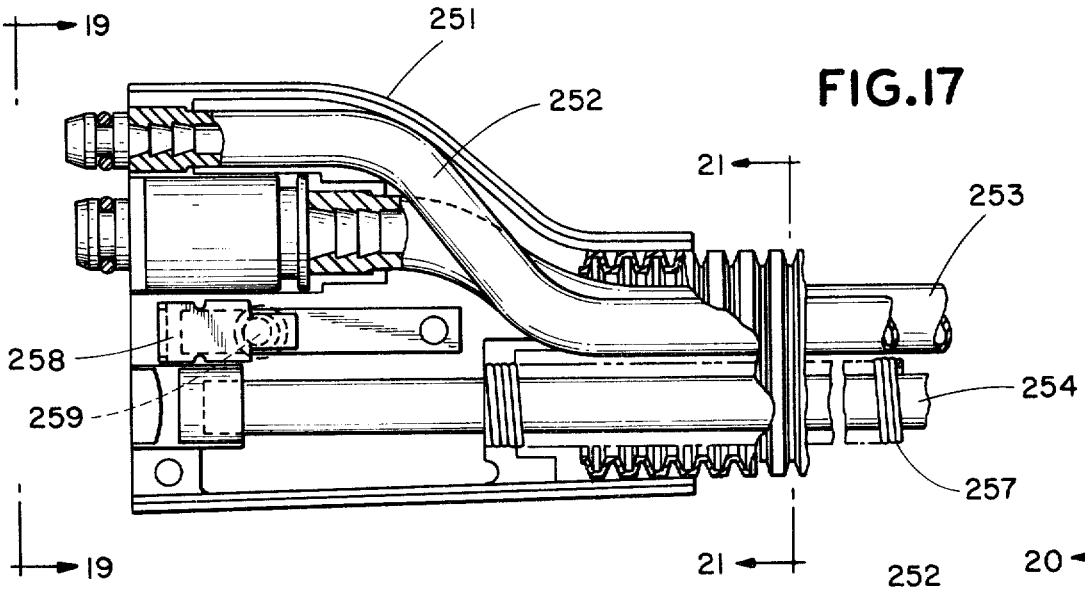
FIG. 17 is a sectional view taken along Lines 17—17 of FIG. 1.
Figure 18:
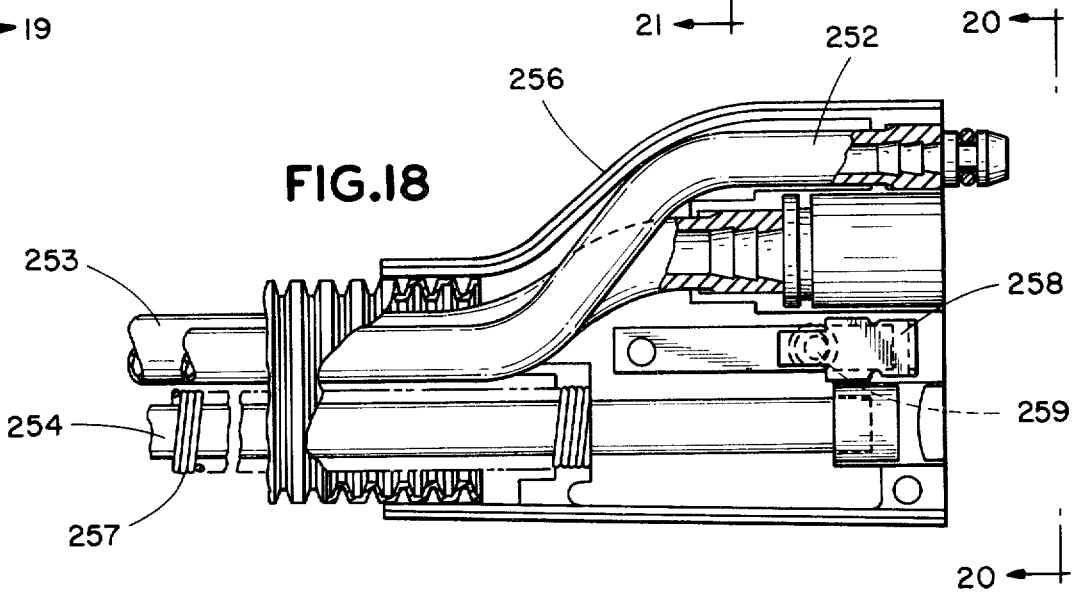
FIG. 18 is a sectional view taken along Lines 18—18 of FIG. 1.
Figure 19:
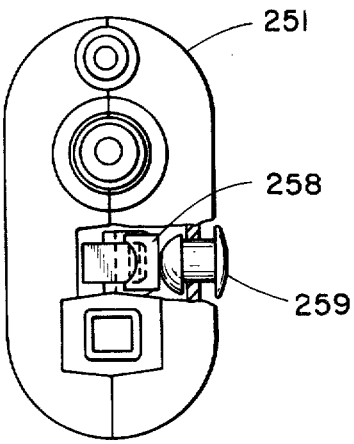
FIG. 19 is a sectional view taken along Lines 19—19 of FIG. 17 assuming
Figure 20:
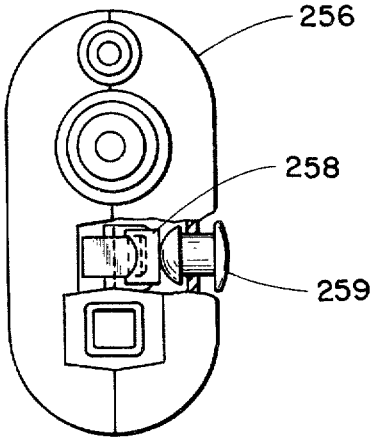
FIG. 20 is a sectional view taken along Lines 20—20 of FIG. 18 assuming
Figure 21:
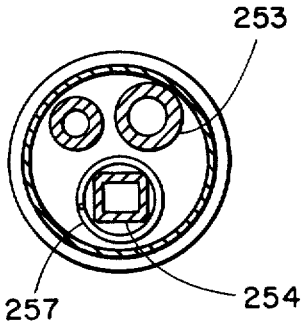
FIG. 21 is a sectional view taken along Lines 21—21 of FIG. 17.

Referring now to FIGS. 17 through 21, the conveyer means is disclosed and comprises a tool disconnect generally indicated at 251 in FIG. 17 having a pilot tube 252 pneumatically connected to the pilot line 228 and a supply tube 253 for pneumatic connection to the supply line 224. A cable tie conveyer tube 254 is positioned for connection to the cable tie tube 136 in the tool member 51. A dispenser disconnect 256 is disclosed in FIG. 18 also containing a pilot tube 252, supply tube 253, and cable tie conveyer tube 254 which tubes are continuous between the tool disconnect and dispenser disconnect. The cable tie conveyer tube 254 may be provided with a spring support 257 to prevent any possible bending of the tube that could possibly result in preventing a cable tie 55 from being transmitted from the dispenser member 53 to the tool member 51. The tool disconnect 251 and dispenser disconnect 256 may be provided with any suitable means preventing inadvertent removal from the associated tool member and dispenser member respectively as shown by the latches 258 positioned for respective engagement with a detent in the tool member and in the dispenser member. A release button 259 is also provided to permit separation of the disconnects from their associated members.

Referring now to FIGS. 23 through 28, disclosed are the schematics disclosing the pneumatic circuitry of the dispenser member 53. It will be appreciated that many combinations could be utilized to bring about the desired end purpose and accordingly, these particular schematics are illustrated as disclosing the preferred embodiment. A dot at the intersection of the lines indicates a connection whereas the absence of a dot indicates a cross over.

Figure 23:
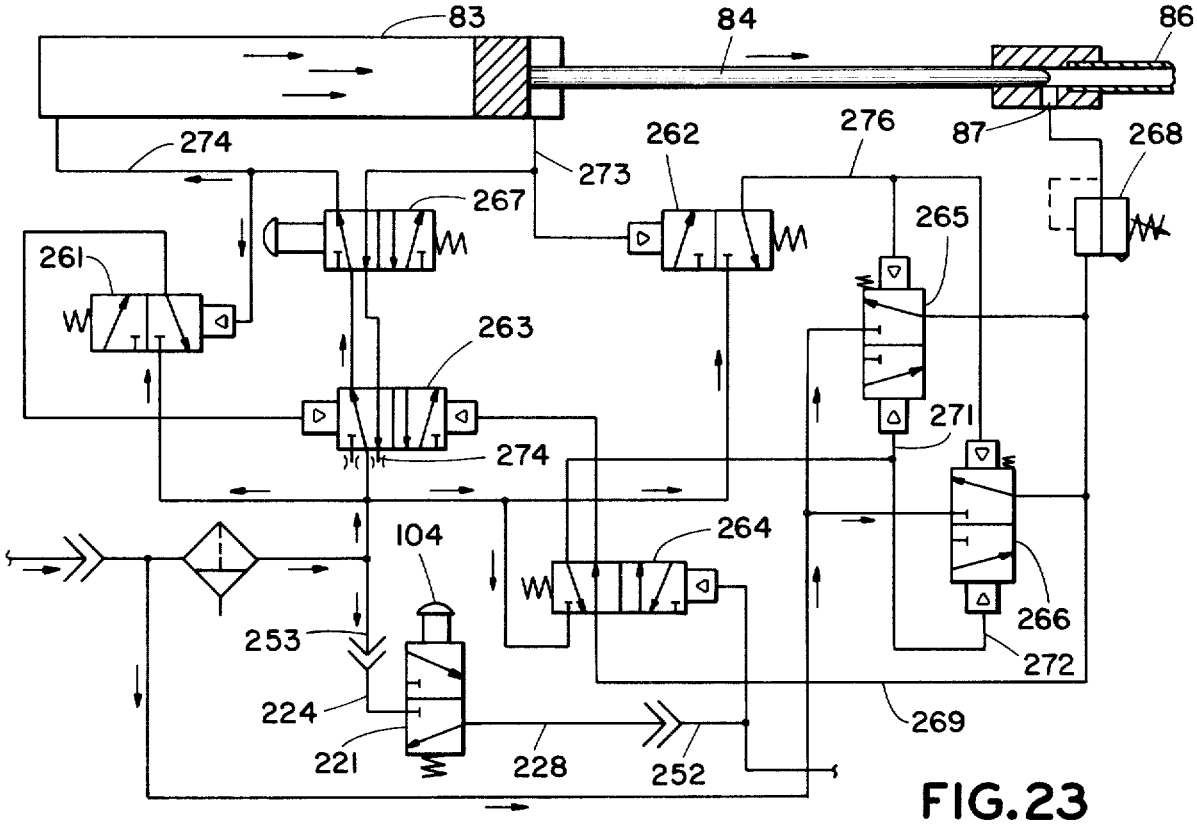
FIGS. 23 through 28 are schematics showing the position of the dispenser valves during a complete tool cycle.

FIG. 23 shows the schematics for a plurality of valves, 261–267, a regulator 268, the cylinder 83 and associated ram 84, in addition to the valve spool 221, the dispenser cable tie tube 86, all of which are shown in position with air pressure applied to the circuit. Arrows are utilized to show air pressure in the various lines. In FIG. 23, Valve 261 is shifted against its spring and the cylinder 83 is under pressure at the head end.

Figure 24:
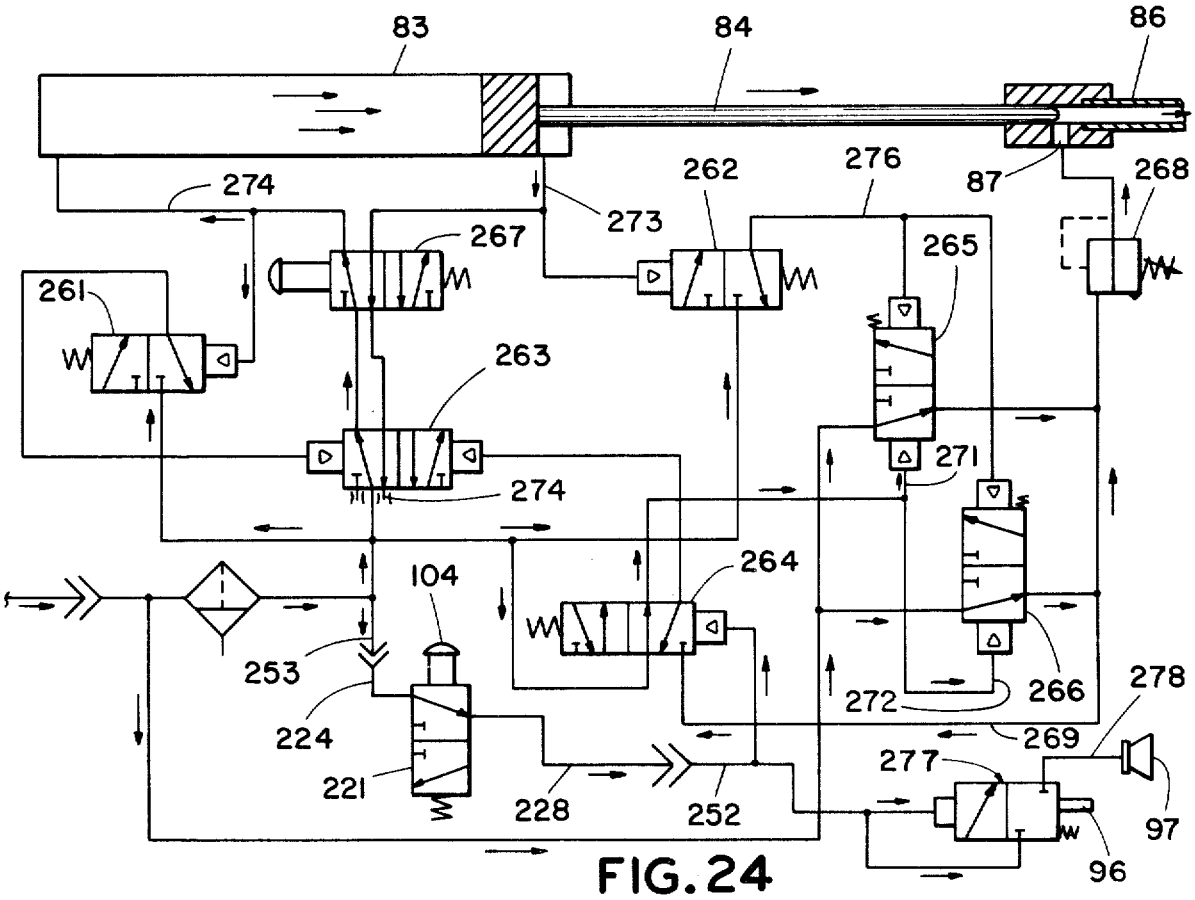
Figure 25:
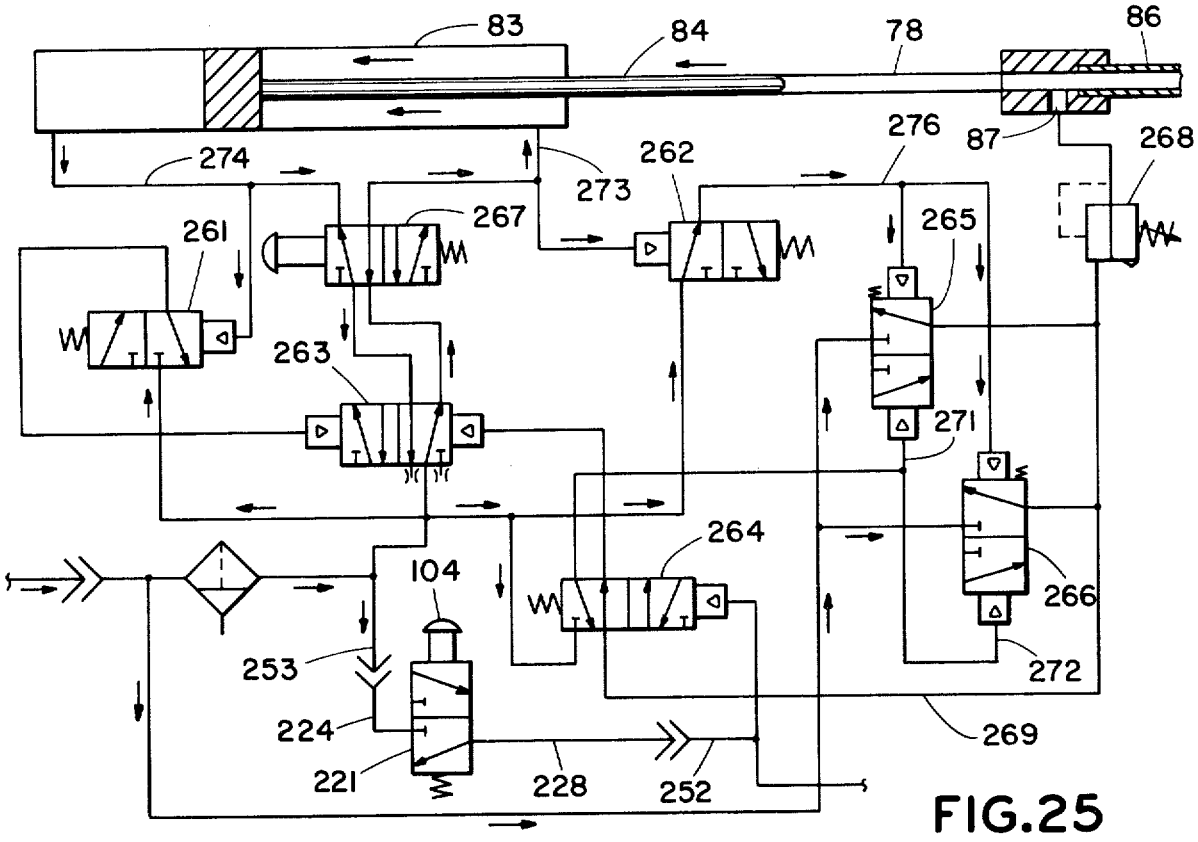

Upon actuation of thumb slide 104 to move actuator rod 111 into latched engagement with the primary wire latch 123, air enters the pilot line 228 as hereinbefore described. In FIG. 24, line pressure shifts Valve 264 thereby permitting pressure to shift Valves 265 and 266 whereupon air passes through the regulator 268 into the dispenser cable tie tube 86 through passageway 87 thereby propelling the cable tie 55 through the cable tie conveyer tube 254 to the tool member 51. At this point as shown in FIG. 24, the cylinder 83 remains under pressure at the head end. Upon return of the actuator rod 111 to its initial position upon completion of the cycle due to the cable tie 55 being applied about a bundle of wires or the like, valve spool 221 closes eliminating air pressure in pilot line 228 whereupon Valve 264 returns under spring pressure to the position shown in FIG. 25. Also in FIG. 25, Valve 263 shifts due to pressure supplied through Valve 264 from Line 269. The pressure is supplied even though Valve 264 has shifted since Valves 265 and 266 remain open slightly after Valve 264 has returned to the position of FIG. 25. Valves 265 and 266 are shown shifted in FIG. 25 under the spring pressure due to loss of pressure in Lines 271 and 272. Accordingly, fluid pressure is no longer supplied to the dispenser cable tie tube 86. The rod 84 also retracts due to pressure in Line 273. Valve 262 shifts pressurizing Valves 265 and 266 thereby preventing reactuation by improper signal from valve spool 221. Thus it will be appreciated that a new cycle cannot be started until the rod 84 has fully retracted permitting another cable tie 55 to be positioned in the dispenser cable tie chamber 78. Back pressure in Line 274 from the head end of the cylinder keeps Valve 261 shifted against its spring as shown in FIG. 25.

Figure 26:
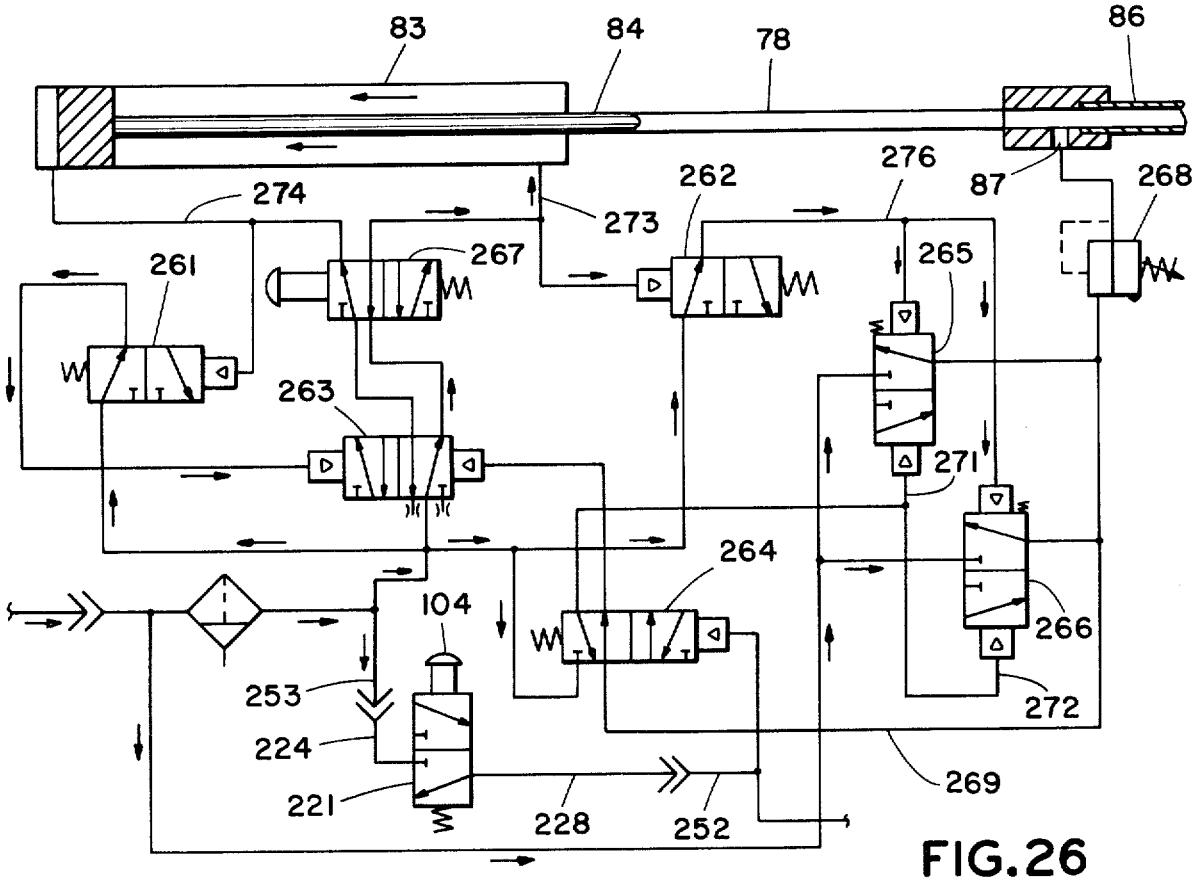
Figure 27:
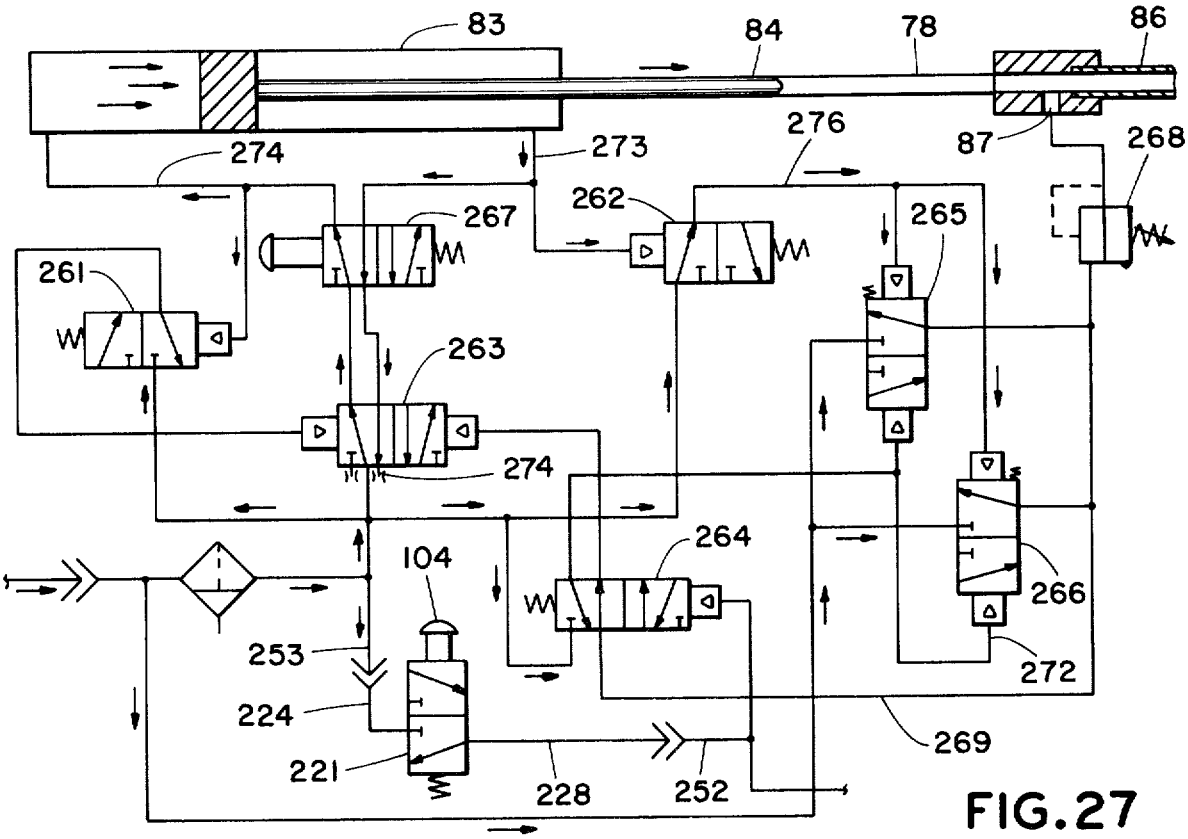

Referring now to FIG. 26, the back pressure in the head end of the cylinder 83 bleeds off through port 274 of Valve 263 which has not yet shifted. Valve 261 shifts under spring tension since back pressure from the cylinder in Line 274 is no longer present. Valve 261 now provides pressure to Valve 263 shifting it and changing the cylinder direction as shown in FIG. 27, where Valve 263 has shifted supplying pressure into the back end of the cylinder 83. Pressure in Line 274 shifts Valve 261 against its spring blocking a signal to shift Valve 263. Back pressure in Line 273 keeps Valve 262 shifted against its spring permitting pressure in Line 276 to pressurize Valves 265 and 266 preventing them from shifting while the cylinder 83 is in motion.

Figure 28:
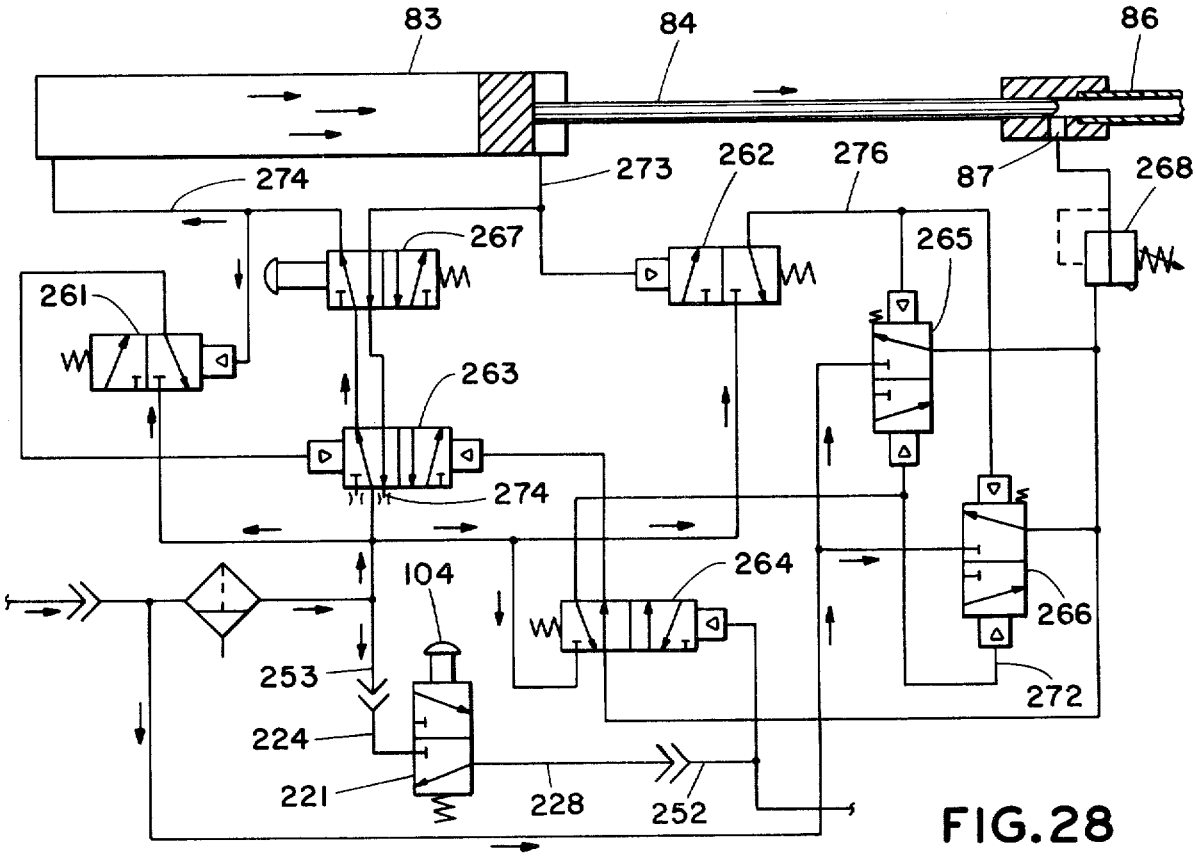

Turning now to FIG. 28, the cylinder has fully extended the rod 84 and delivered a cable tie to the dispenser cable tie tube 86 with the tip of the rod sealing the cable tie tube so that upon application of the air pressure into passageway 87 as described with reference to FIG. 24, the cable tie 55 will be transmitted to the tool member. Back pressure in Line 273 bleeds off through Valve 262 upon full extension of rod 84 thereby removing line pressure from Line 276 and permitting Valves 265 and 266 to shift upon receipt of the pilot signal from the tool member 51 as shown in FIG. 24. This restores the circuit to the form of FIG. 23 whereby the circuit is ready for another cycle upon actuation of the valve spool 221.

Valve 267 is a manually operable valve actuated by removal or closure of the access door 89 of the dispenser member 53. When the access door is removed, Valve 267 shifts from the position shown and retracts the cylinder rod 84 permitting removal of any material which may be jamming the dispenser cable tie tube 86. Closure of the front cover permits Valve 267 to return to its position as shown under the force of its return spring.

Referring back to FIG. 24, there is shown Valve 277. When air enters the Line 252, the probe 96 is urged between the sides of cartridge through the probe opening 69. If the probe 96 engages a cable tie or the end of the feeder arm 58, further movement thereof is limited and nothing happens. If the feeder arm 58 has moved below the probe 96 then the additional movement of the probe into the cartridge shifts Valve 277 sending air under pressure into Line 298 actuating the signal 97. In this manner, the operator is informed when a new cartridge should be inserted into the dispenser. It will thus be appreciated that a cable tie will always be positioned in the cable tie chamber 78 for transmittal into the dispenser cable tie tube for transmittal to the tool member 51 upon receipt of the pilot signal from the tool. In the event an operator should fail to respond to the signal 97 and the cycle is actuated, a cable tie will be transmitted to the tool but there will not be a cable tie available for positioning in the cable tie chamber 78. It should be appreciated that the next subsequent cycle cannot be completed since a cable tie will not be transmitted to the tool member 51 and the cutoff necessary to release the primary wire latch 123 and terminate the cycle will not occur. Accordingly, in this event, it will be necessary to actuate the reset button 236.

Having thus described the mechanism of the tool, a complete cycle will now be explained in order that the overall operation of the automatic cable tie installation tool and the interaction of the parts thereof may be better appreciated.

The operator first engages the lower jaw trigger 101 to separate the upper and lower jaws 156, 102 and permit the jaws of the tool to be placed around the bundle of wires 103. Next, the slide 104 is actuated a predetermined distance whereupon air pressure in Line 226 behind the primary spool 222 forces the actuator rod 111 to the position as shown in FIG. 3. Simultaneously, air is supplied to the motor 181 driving the gears 182, 183, 186, 187, and 193. Also, simultaneously, a pilot signal is transferred through pilot line 228 to the dispenser whereupon fluid pressure enters the dispenser cable tie tube 86 forcing the cable tie 55 from the dispenser member 53, through the conveyer member 52 into position adjacent the head stop 137 in the cable tie tube 136 in the tool member 51 with the strap portion following the guide surface defined by the upper and lower jaws 156, 102, and coming to rest with the tip thereof in a position adjacent the opening in the cable tie head.

Once the cable tie head passes the inlet passageway 146 in the cable tie tube 136, fluid pressure enters behind the diaphragm 148 urging the diaphragm rod 152 to the left in FIG. 14 causing the pin actuating link 154 to pivot and move the pin 173 to the right from its position in FIG. 12. This brings the pin into engagement with one of the radial ramps 188 of the cam gear driving the upper jaw 156 into the position as shown in FIG. 4. As the pin 173 is urged radially outwardly from the cam gear shaft 172 by ramp 188, it engages one of the lateral ramps 189 and is urged laterally from the face of the gear 187 until it returns to the position of FIG. 12. The pin 173 cannot return from the position of FIG. 4 as long as the pin actuating link 154 is pivoted from the position in FIG. 14 as the link prevents its return once the pin 173 has moved to the position of FIG. 12. The movement of the upper jaw 156 relative to the lower jaw 102 threads the cable tie tip through the opening in the cable tie head directing the tip through the aperture 209 and between the gripper gear 193 and cable tie guide 196 whereupon the gripper gear continues to tension the cable tie until the predetermined tension as set by the bias on the detent 210 is reached whereupon the cam follower 201 moves out of its position in the detent and the gripper plates 194 rotate about the pivot pin 195 moving the cutter blade 206, due to the engagement of the cutter blade actuators 203 with the upstanding arms 207, as shown in FIG. 4 and severing the threading portion of the cable tie adjacent the cable tie head.

Simultaneously, the latch release arm 204 engages the latch frame 127 and pivots the latch frame upwardly from the position in FIG. 3 to the position in FIG. 4 wherein the primary wire latch 123 is removed from the rod detent 122 and the secondary spring latch 124 engages the rod detent. The cam surface 213 adjacent the cutter detent 210, now that the force is removed from the gripper plates 194, urges the cam follower 201 back into position in the cutter detent 210 whereupon the latch frame 127 is moved back to its original position as shown in FIG. 3 removing the secondary spring latch 124 from engagement in the rod detent 122 permitting the rod actuator 111 to return to its original position. As the gripper plates 194 return to their position as shown in FIG. 3, the cutter blade actuators 203 return the cutter blade to the position of FIG. 3. Upon the return of the actuator rod 111, the head retainer 139 is removed permitting the cable tie head to be removed from the tool member 51. With the cable tie head removed from the end of the cable tie tube 136, pressure behind the diaphragm 148 is eliminated whereupon the diaphragm rod 152 and pin actuating link 154 will return to the positions as shown in FIG. 14 permitting the pin 173 to return to the position of FIG. 3.

Upon return of the actuator rod 111 to its original position, another cable tie is transferred from the cable tie chamber 78 into the dispenser cable tie tube 86 and the rod 84 has sealed the end of the cable tie tube 86 whereupon another cable tie is positioned for transmittal to the tool member 51.

The preceding cycle takes place in less than a second.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

We claim:

1. A tool for fastening a cable tie having a strap portion and a head portion about a bundle of wires or the like comprising tensioning means for tensioning the cable tie about the bundle of wires or the like, severing means for cutting the tail of the strap portion once it has been tensioned about the bundle of wires or the like, said tensioning means comprising a rotary driven member adapted to develop a tension in the cable tie, said rotary driven member being spaced from a fixed strap guide a distance to define an interference fit for the strap portion, and biasing means for restraining movement of said severing means until a predetermined tension is developed in said cable tie, actuation of said severing means being independent of operator decision once the predetermined tension is developed.

2. A tool for fastening a cable tie having a strap portion and a head portion about a bundle of wires or the like comprising tensioning means for tensioning the cable tie about the bundle of wires or the like, and severing means for cutting the tail of the strap portion once it has been tensioned about the bundle of wires or the like, said tensioning means comprising a rotary driven member adapted to develop a tension in the cable tie, said driven member comprising a gear supported on a plate mounted for pivotal movement within said tool; said plate being biased to a first position whereby when a predetermined tension is developed in said cable tie, said plate pivots and moves to a second position.

3. The cable tie installation tool of claim 2 wherein said plate is connected to said severing means whereby pivotal movement of said plate actuates said severing means.

4. The cable tie installation tool of claim 2 wherein said plate is pivotally mounted by a pin positioned on the pitch line of said gear.

5. A tool for fastening a cable tie having a strap portion and a head portion about a bundle of wires or the like comprising tensioning means for tensioning the cable tie about the bundle of wires or the like, and severing means for cutting the tail of the strap portion once it has been tensioned about the bundle of wires or the like, said tensioning means comprising a rotary driven member adapted to develop a tension in the cable tie, and biasing means for restraining movement of said severing means until a predetermined tension is developed in said cable tie, said rotary driven member comprising a gripper supported by supporting means for actuating said severing means, said supporting means being mounted in said tool for movement from a first position wherein said gripper is positioned to tension the cable tie to a second position wherein said supporting means actuates said severing means.

6. A tool for fastening a cable tie having a strap portion and a head portion about a bundle of wires or the like comprising tensioning means for tensioning the cable tie about the bundle of wires or the like, and severing means for cutting the tail of the strap portion once it has been tensioned about the bundle of wires or the like, said tensioning means comprising a rotary driven member adapted to develop a tension in the cable tie, and biasing means for restraining movement of said severing means until a predetermined tension is developed in said cable tie, said rotary driven member being fluid driven.

7. The cable tie installation tool of claim 6 wherein said tool further comprises a fluid actuated motor having a motor gear and said rotary driven member comprises a gear interconnected to said motor gear.

8. A tool for fastening a cable tie about a bundle of wires or the like comprising positioning means for positioning the cable tie in a closed loop about the bundle of wires or the like, tensioning means for tensioning the cable tie about the bundle of wires or the like, severing means for cutting the tail of the cable tie once it has been tensioned about the bundle of wires or the like, and cycle actuating means for actuating the cycle of said tool member, said cycle actuating means being movable from a first position to a second position wherein the tool is actuated, said tool member having locking means for preventing premature cycling wherein movement of said cycle actuating means to said second position actuates both the cycle and said locking means and disengages said cycle actuating means from repeated initiation of a new cycle until the cycle has been completed and a cable tie has been positioned in a closed loop about the bundle of wires or the like and the tail of the cable tie has been severed.

9. The tool of claim 8 wherein said cycle actuating means comprises an actuator rod mounted within said tool member for movement therein between first and second positions, a slide is mounted on the tool housing for slidable movement relative thereto, said slide being connected to a slide actuator having a rod actuator resiliently biased toward said actuator rod and adapted to engage a shoulder on said actuator rod for moving said actuator rod from said first position, said locking means comprises a latch positioned for engagement with said actuator to prevent movement of said rod actuator from said second position irrespective of movement of said slide.

10. A tool for fastening a cable tie having a strap portion and a head portion about a bundle of wires or the like comprising positioning means for positioning the cable tie in a closed loop about the bundle of wires or the like, tensioning means for tensioning the cable tie about the bundle of wires or the like, and severing means for cutting the tail of the cable tie once it has been tensioned about the bundle of wires or the like, said positioning means comprising jaw means for threading a tip of said cable tie through said head portion into engagement with said tensioning means, said jaw means being movable from a first position permitting placement of the jaw means about a plurality of wires or the like to an additional position, movement of said jaw means from said first position to said additional position being adapted to thread the tip of said cable tie into engagement with said tensioning means, and jaw actuating means for moving said jaw means from said first position to said additional position.

11. The tool of claim 10 wherein said jaw actuating means is provided with an override whereby application of a predetermined force to said jaw means prevents movement of said jaw means to said additional position.

12. The tool of claim 11 wherein said jaw actuating means comprises a rod pivotably connected to said jaw means and a sleeve disposed on said rod having a detent positioned in a groove in the rod whereby movement of said sleeve brings about movement of said rod until a restraining force is developed in the rod sufficient to cam the detent out of said groove thereby permitting relative movement between said sleeve and said rod.

13. The automatic cable tie installation tool of claim 10 wherein said tensioning means comprises a driven gear having a plurality of teeth thereon adapted to engage a cable tie and develop a tension in the cable tie.

14. The cable tie installation tool of claim 13 wherein said gear is supported on a plate mounted for pivotal movement within said tool; said plate being connected to a cam follower positioned in a biased detent whereby when a predetermined tension is developed in said cable tie said plate pivots and moves said cam follower out of said detent.

15. The cable tie installation tool of claim 14 wherein said plate is connected to said severing means whereby pivotal movement of said plate actuates said severing means.

* * * * *